US010625501B2

(12) United States Patent
Shomura et al.

(10) Patent No.: US 10,625,501 B2
(45) Date of Patent: Apr. 21, 2020

(54) RECORDING APPARATUS

(71) Applicant: SEIKO EPSON CORPORATION, Tokyo (JP)

(72) Inventors: Hikari Shomura, Inzai (JP); Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/991,778

(22) Filed: May 29, 2018

(65) Prior Publication Data

US 2018/0345692 A1 Dec. 6, 2018

(30) Foreign Application Priority Data

May 31, 2017 (JP) ..... 2017-108352

(51) Int. Cl.

| | |
|---|---|
| ***B41J 2/045*** | (2006.01) |
| ***B41J 11/00*** | (2006.01) |
| ***B41J 2/21*** | (2006.01) |
| ***B41J 13/02*** | (2006.01) |
| ***B41J 2/155*** | (2006.01) |

(52) U.S. Cl.

CPC ..... *B41J 2/04573* (2013.01); *B41J 2/04556* (2013.01); *B41J 2/155* (2013.01); *B41J 2/2132* (2013.01); *B41J 11/0045* (2013.01); *B41J 13/02* (2013.01)

(58) Field of Classification Search

CPC .... B41J 2/04573; B41J 2/04556; B41J 2/155; B41J 2/2132; B41J 13/02; B41J 11/0045

See application file for complete search history.

(56) References Cited

U.S. PATENT DOCUMENTS

| | | | | |
|---|---|---|---|---|
| 2006/0246212 | A1* | 11/2006 | Takahashi | B41J 11/008 427/8 |
| 2013/0135389 | A1* | 5/2013 | Ito | B41J 11/005 347/37 |
| 2013/0257948 | A1 | 10/2013 | Terada | |
| 2015/0029254 | A1 | 1/2015 | Arakane | |

FOREIGN PATENT DOCUMENTS

| | | |
|---|---|---|
| JP | 2000-071532 A | 3/2000 |
| JP | 2013-212586 A | 10/2013 |
| JP | 2015-024601 A | 2/2015 |

* cited by examiner

*Primary Examiner* — Julian D Huffman
(74) *Attorney, Agent, or Firm* — Workman Nydegger

(57) ABSTRACT

When a wave shape is formed in a sheet of paper, a suppression of a reduction in recording quality that is caused by a shape of the paper is achieved, and thus, favorable recording quality is obtained.

13 Claims, 20 Drawing Sheets

$$A = \overline{yt} - \overline{yb} \quad \cdots (1)$$

$$yj = \frac{A}{2} \sin\left[\left(\frac{2\pi}{L}\right)\left(x + \frac{3}{4}L\right)\right] \quad \cdots (2)$$

$$T = \frac{yh - yj}{v} \quad \cdots (3)$$

$$Sn = S + (T_{max} - T_n) \quad \cdots (4)$$

RECORDING APPARATUS

BACKGROUND

1. Technical Field

The present disclosure relates to a recording apparatus which performs recording on a medium.

2. Related Art

A recording apparatus which is represented by an ink jet printer is provided with a medium support member (also referred to as a platen) at a position facing a recorder which performs recording on paper which serves as a medium, and the recording apparatus is configured such that a distance (also referred to as a platen gap) between the recorder and the paper is defined due to the paper being supported by the medium support member.

In such recording apparatuses, there is a recording apparatus which is configured such that corrugation (also referred to as cockling), which has a wave shape in a direction intersecting the medium transport direction, is formed in the paper before the recording by the recorder in order to suppress lifting up of the paper on the medium support member. For example, JP-A-2000-71532 discloses a recording apparatus which is provided with, as a forming unit which generates surface waviness of the recording sheet material S in a sheet material width direction, a plurality of ribs 13 and a recessed portion 15 on a top surface of a platen (a medium support member) which guides a rear surface of a recording sheet material S under a recording head 1 (a recorder).

The paper in which the corrugation is formed is given firmness, the rigidity is increased, and the posture of the paper on the platen 11 is stabilized. Therefore, favorable recording image quality may be obtained by the recording head 1.

When an ordinary ink discharging process is performed on the paper in which the corrugation is formed, differences arise in the time until the ink lands at the positions of the peaks and troughs of the corrugation and the desired recording quality may not be obtained.

Meanwhile, from a perspective of reliably suppressing the lifting up of the paper, it is necessary to more reliably form the corrugation along the entirety of the region facing the recording head. However, the more reliably the corrugation is formed, the more notable the drop in the recording quality which originates from the corrugation which is formed in the paper.

Since the wave shape which is formed in the paper changes depending on changes in a transport roller which transports the paper and the interrelation (contact state) of the paper with respect to the wave shape which forms the surface waviness in the paper, it is preferable to also consider this point in order to obtain more favorable recording quality.

SUMMARY

An advantage of some aspects of the disclosure is that a wave shape is more reliably formed in a sheet of paper in order to more reliably suppress lifting up of the paper, a suppression of a reduction in recording quality that is caused by a shape of the paper is achieved, and thus, favorable recording quality is obtained.

According to an aspect of the disclosure, a recording apparatus includes a liquid discharge unit which is provided with a plurality of liquid discharging nozzles which discharge a liquid onto a medium which is transported, an upstream-side transport unit which is provided on an upstream side of the liquid discharge unit in a medium transport direction, a downstream-side transport unit which is provided on a downstream side of the liquid discharge unit in the medium transport direction, and a forming unit which is provided on the upstream side of the liquid discharge unit in the medium transport direction and forms in the medium, alternately in a width direction which intersects the medium transport direction, first convex portions which extend along the medium transport direction and are convex in one surface of the medium and second convex portions which extend along the medium transport direction and are convex in another surface of the medium, in which the upstream-side transport unit is a transport roller pair, and a plurality of the transport roller pairs which nip and transport the medium are disposed along the width direction, in which the transport roller pairs nip either the first convex portions or the second convex portions which are formed in the medium, and in which the control unit which controls discharging of the liquid of the liquid discharging nozzles controls the discharging of the liquid of the liquid discharging nozzles according to shapes of the first convex portions and the second convex portions which are formed in the medium between the upstream-side transport unit and the downstream-side transport unit.

In this configuration, since the upstream-side transport unit which is provided on the upstream side of the liquid discharge unit in the medium transport direction is a transport roller pair, and a plurality of the transport roller pairs which nip and transport the medium are disposed along the width direction and the transport roller pairs nip either the first convex portions or the second convex portions, it is possible to suppress the action of the upstream-side transport unit in a direction which cancels out the wave shape (undulations formed from the first convex portions and the second convex portions) which is formed by the forming unit, that is, it is possible to favorably maintain the wave shape which is formed by the forming unit and transport the medium, and so it is possible to obtain more favorable recording quality.

With this premise, since the control unit which controls the discharging of the liquid of the liquid discharging nozzles controls the discharging of the liquid of the liquid discharging nozzles according to the shape of the first convex portions and the second convex portions which are formed in the medium between the upstream-side transport unit and the downstream-side transport unit, even if the medium deforms between the upstream-side transport unit and the downstream-side transport unit, it is possible to obtain favorable recording quality due to the liquid being discharged according to the deformation.

In the recording apparatus, the control unit may control the discharging of the liquid of the liquid discharging nozzles according to a contact state of the medium with respect to the upstream-side transport unit or the downstream-side transport unit.

There is a case in which the shape of the medium changes according to changes in the contact state of the medium with respect to the upstream-side transport unit and the downstream-side transport unit. In this configuration, since the control unit controls the discharging of the liquid of the liquid discharging nozzles according to the contact state of the medium with respect to the upstream-side transport unit and the downstream-side transport unit, even if the shape of the medium changes according to changes in the contact state of the medium with respect to the upstream-side transport unit and the downstream-side transport unit, favorable recording results may be obtained.

Examples of "the contact state (the interrelation) of the medium with respect to the upstream-side transport unit and the downstream-side transport unit" include, for example, a state in which the medium is transported by only the upstream-side transport unit, a state in which the medium is transported by both the upstream-side transport unit and the downstream-side transport unit, and a state in which the medium is transported by only the downstream-side transport unit.

In the recording apparatus, the control unit may control the discharging of the liquid of the liquid discharging nozzles according to a contact state of the medium with respect to the forming unit.

There is a case in which the shape of the medium changes according to changes in the contact state of the medium with respect to the forming unit. In this configuration, since the control unit controls the discharging of the liquid of the liquid discharging nozzles according to the contact state of the medium with respect to the forming unit, even if the shape of the medium changes according to changes in the contact state of the medium with respect to the forming unit, favorable recording results may be obtained.

Examples of "the contact state (the interrelation) of the medium with respect to the forming unit" include, for example, a state in which the medium approaches the forming unit and a state in which the medium does not approach the forming unit.

In the recording apparatus, the control unit may ensure that a discharge amount of the liquid with respect to positions between the first convex portions and the second convex portions is greater than a discharge amount of the liquid with respect to the first convex portions and the second convex portions.

Since the positions between the first convex portions and the second convex portions are inclined surfaces when the liquid is discharged onto the medium from the normal line direction with respect to the surface (the surface of a case in which it is assumed that the surface of the medium is a flat surface) of the medium, the formed dot interval is spread out in comparison to the dot interval at the first convex portions and the second convex portions and density irregularities are generated. In this configuration, since the control unit ensures that a discharge amount of the liquid with respect to positions between the first convex portions and the second convex portions is greater than a discharge amount of the liquid with respect to the first convex portions and the second convex portions, it is possible to suppress the density irregularities.

In the recording apparatus, when forming a plurality of dots on the medium using the discharging of the liquid along the width direction, the control unit may thin the liquid discharging nozzles to be used during dot formation onto the first convex portions and the second convex portions.

Since the positions between the first convex portions and the second convex portions are inclined surfaces when the liquid is discharged onto the medium from the normal line direction with respect to the surface (the surface of a case in which it is assumed that the surface of the medium is a flat surface) of the medium, the formed dot interval is spread out in comparison to the dot interval at the first convex portions and the second convex portions and image quality irregularities are generated. In this configuration, since the control unit thins the liquid discharging nozzles to be used during dot formation onto the first convex portions and the second convex portions when forming a plurality of dots on the medium using the discharging of the liquid along the width direction, it is possible to render the dot interval at the first convex portions and the second convex portions the same as or closer to the dot interval at the positions between the first convex portions and the second convex portions, and it is possible to suppress the density irregularities.

In the recording apparatus, the control unit may contract a size of a recording region in the width direction based on recording data corresponding to a width of the medium which is contracted by the forming unit.

When the wave shape is formed in the medium by the forming unit, the size of the medium is contracted in the width direction. In this configuration, since the control unit contracts the size, in the width direction of the recording region based on the recording data, corresponding to the width of the medium which is contracted by the forming unit, it is possible to avoid the discharging of the liquid at positions at which the medium is not present, and it is possible to suppress the fouling of the apparatus of the liquid.

In a case in which the size of the recording region in the width direction based on the recording data is contracted to correspond to the width of the medium which is contracted by the forming unit, it is possible to adopt at least one method of a method of contracting the overall recording region and a method of discarding the end portions of the recording region.

In the recording apparatus, when performing recording on a second surface which is a surface of an opposite side to a first surface of the medium on which recording is first performed, the control unit may control the discharging of the liquid of the liquid discharging nozzles according to a discharge amount of the liquid onto the first surface.

When the recording is performed on the second surface, which is the surface of the opposite side to the first surface of the medium on which the recording is first performed, since the rigidity of the medium changes according to the discharge amount of the liquid onto the first surface, the amplitude of the wave shape which is formed in the medium also changes. In this configuration, when performing the recording on the second surface which is a surface of an opposite side to the first surface of the medium on which recording is first performed, since the control unit controls the discharging of the liquid of the liquid discharging nozzles according to the discharge amount of the liquid onto the first surface, more favorable recording results may be obtained.

In the recording apparatus, the forming unit may be provided on the upstream side of the upstream-side transport unit in the medium transport direction, and the control unit may control the discharging of the liquid of the liquid discharging nozzles according to a state corresponding to any one of a first state in which the medium is in contact with the forming unit and the upstream-side transport unit and a leading end of the medium does not reach the downstream-side transport unit, a second state in which the medium is in contact with the forming unit, the upstream-side transport unit, and the downstream-side transport unit, a third state in which a rear end of the medium leaves the forming unit and the medium is in contact with the upstream-side transport unit and the downstream-side transport unit, and a fourth state in which the rear end of the medium leaves the upstream-side transport unit and the medium is in contact with the downstream-side transport unit.

In this configuration, since the control unit controls the discharging of the liquid of the liquid discharging nozzles according to which of any one of the first state to the fourth state is applicable, even if the deformation state of the medium is different in each of the states, it is possible to obtain favorable recording quality due to the liquid being discharged accordingly.

In the recording apparatus, the liquid discharge unit may be provided with a plurality of nozzle rows along the width direction, where a plurality of the liquid discharging nozzles are arranged along the medium transport direction in each nozzle row, in the first state and the second state, the control unit may use the liquid discharging nozzles closer to an outside in the width direction going toward the downstream side in the medium transport direction of the liquid discharging nozzles to be used during predetermined dot formation, in the third state, the control unit may use the liquid discharging nozzles which have a same position in the width direction of the liquid discharging nozzles to be used during the predetermined dot formation, and in the fourth state, the control unit may use the liquid discharging nozzles closer to an inside in the width direction going toward the downstream side in the medium transport direction of the liquid discharging nozzles to be used during predetermined dot formation.

In this configuration, in a case in which the deformation state of the medium is different in each of the states from the first state to the fourth state, it is possible to obtain favorable recording quality due to the liquid being discharged accordingly.

In the recording apparatus, the forming unit may include an upstream-side forming unit which is provided on the upstream side of the upstream-side transport unit in the medium transport direction and a downstream-side forming unit which is provided between the liquid discharge unit and the downstream-side transport unit in the medium transport direction, and the control unit may control the discharging of the liquid of the liquid discharging nozzles according to a state corresponding to any one of a first state in which the medium is in contact with the upstream-side forming unit and the upstream-side transport unit and the leading end of the medium does not reach the downstream-side forming unit, a second state in which the medium is in contact with the upstream-side forming unit, the upstream-side transport unit, and the downstream-side forming unit, a third state in which the medium is in contact with the upstream-side forming unit, the upstream-side transport unit, the downstream-side forming unit, and the downstream-side transport unit, a fourth state in which the rear end of the medium leaves the upstream-side forming unit and the medium is in contact with the upstream-side transport unit, the downstream-side forming unit, and the downstream-side transport unit, and a fifth state in which the rear end of the medium leaves the upstream-side transport unit and the medium is in contact with the downstream-side forming unit and the downstream-side transport unit.

In this configuration, since the control unit controls the discharging of the liquid of the liquid discharging nozzles according to which of any one of the first state to the fifth state is applicable, even if the deformation state of the medium is different in each of the states, it is possible to obtain favorable recording quality due to the liquid being discharged accordingly.

In the recording apparatus, the liquid discharge unit may be provided with a plurality of nozzle rows along the width direction, where a plurality of the liquid discharging nozzles are arranged along the medium transport direction in each nozzle row, in the first state, the control unit may use the liquid discharging nozzles closer to an outside in the width direction going toward the downstream side in the medium transport direction of the liquid discharging nozzles to be used during predetermined dot formation, in the second state and the third state, the control unit may use the liquid discharging nozzles which have a same position in the width direction of the liquid discharging nozzles to be used during the predetermined dot formation, and in the fourth state and the fifth state, the control unit may use the liquid discharging nozzles closer to an inside in the width direction going toward the downstream side in the medium transport direction of the liquid discharging nozzles to be used during predetermined dot formation.

In this configuration, in a case in which the deformation state of the medium is different in each of the states from the first state to the fourth state, it is possible to obtain favorable recording quality due to the liquid being discharged accordingly.

In the recording apparatus, the downstream-side transport unit may be output roller pairs which nip and transport the medium and may be formed by nipping portions which nip one of the first convex portions and the second convex portions and escape portions which allow the other to escape being disposed alternately along the width direction when nipping the medium.

In this configuration, since the downstream-side transport unit is output roller pairs which nip and transport the medium and is formed by nipping portions which nip one of the first convex portions and the second convex portions and escape portions which allow the other to escape being disposed alternately along the width direction when nipping the medium, it is possible to more effectively maintain the wave shape of the medium between the output roller pairs and the transport roller pairs which serve as the upstream-side transport unit, that is, in the recording region of the recording unit.

In the recording apparatus, the nipping portions in the transport roller pairs and the nipping portions in the output roller pairs may be disposed at corresponding positions in the width direction.

Since the nipping portions in the transport roller pairs and the nipping portions in the output roller pairs are disposed at corresponding positions in the width direction, it is possible to more effectively maintain the wave shape of the medium between the output roller pairs and the transport roller pairs (the recording region of the recording unit).

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Hereinafter, an embodiment of the disclosure will be described with reference to the drawings. In the present embodiment, an ink jet printer 1 (hereinafter, there is a case in which this is simply referred to as "the printer 1") is given as an example of the recording apparatus.

Figure 1:
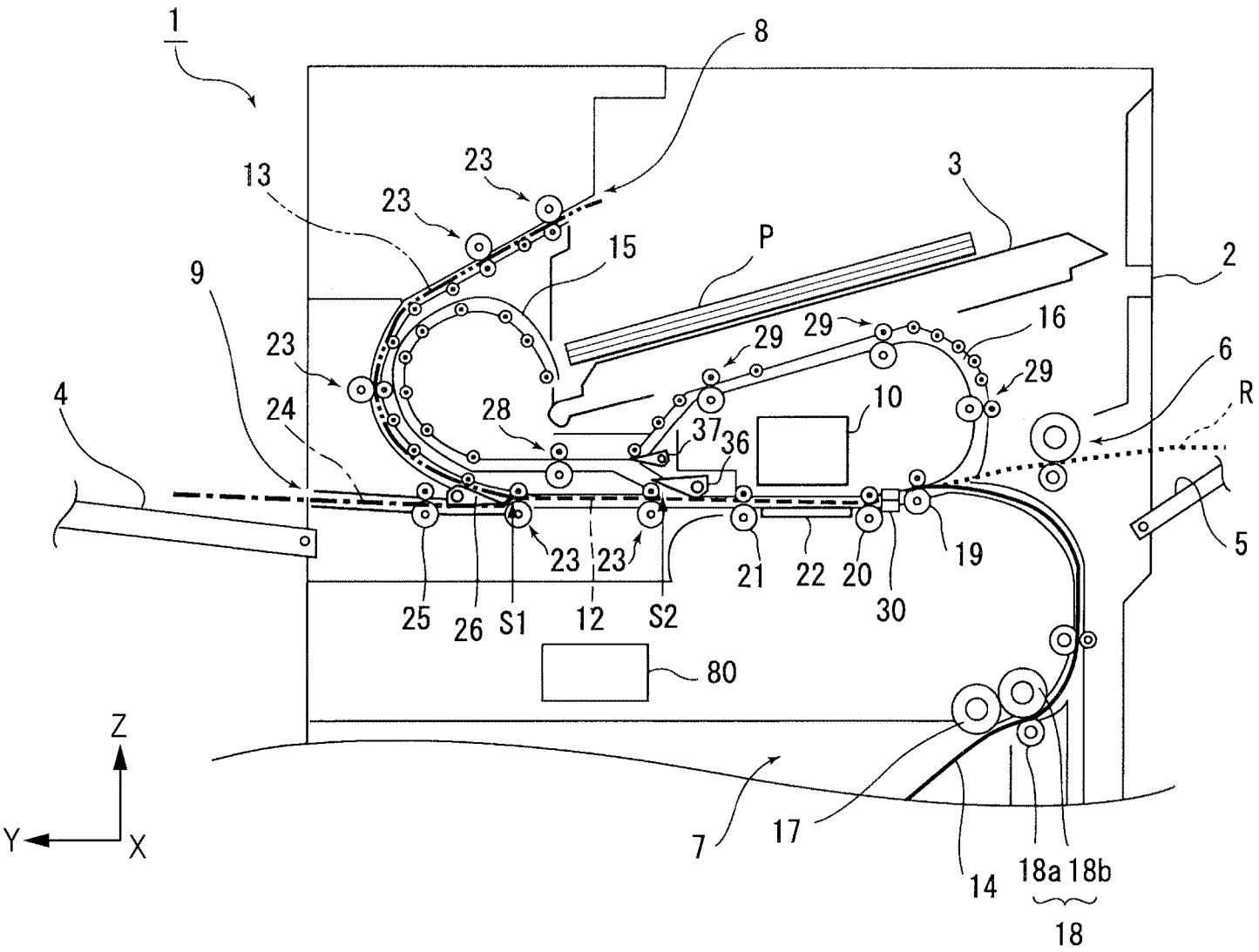
FIG. 1 is a schematic diagram illustrating a paper transport path in a printer according to Example 1.
Figure 2:
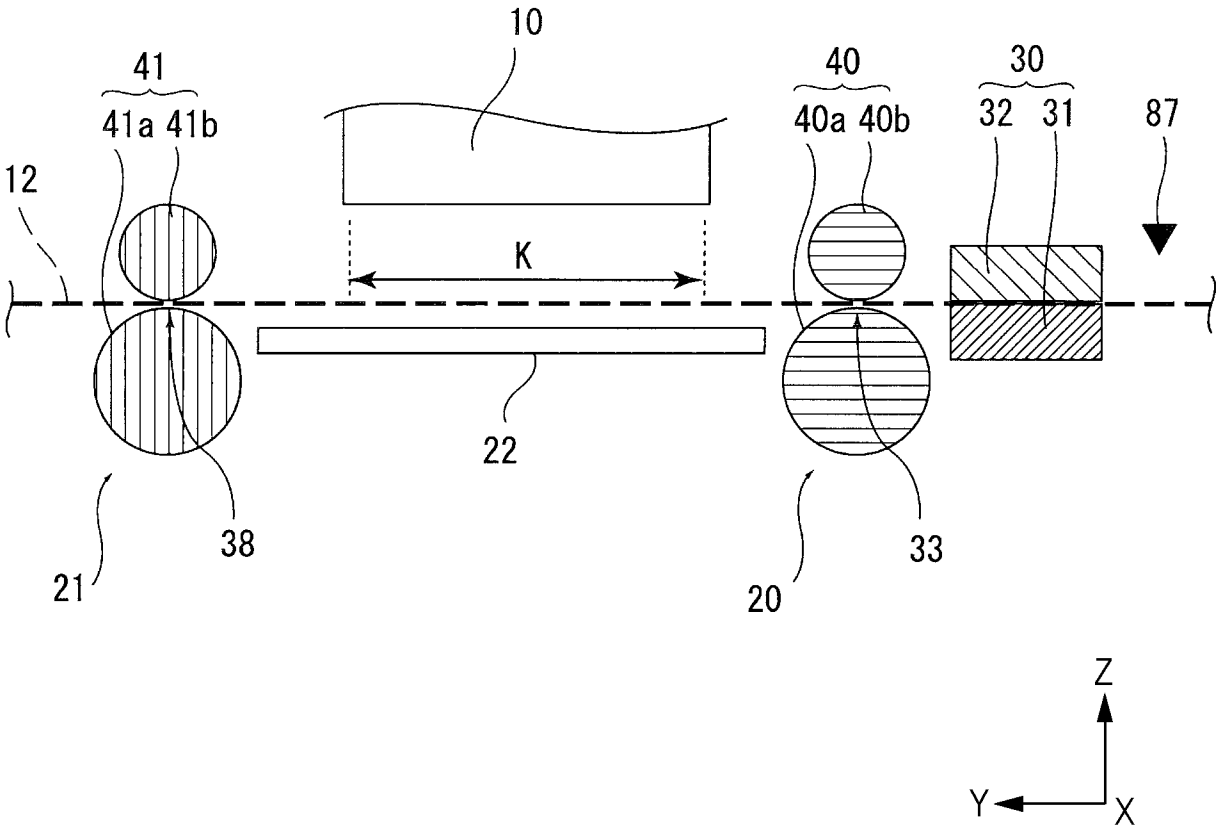
FIG. 2 is a schematic lateral diagram of a periphery of a recording unit.
Figure 3:
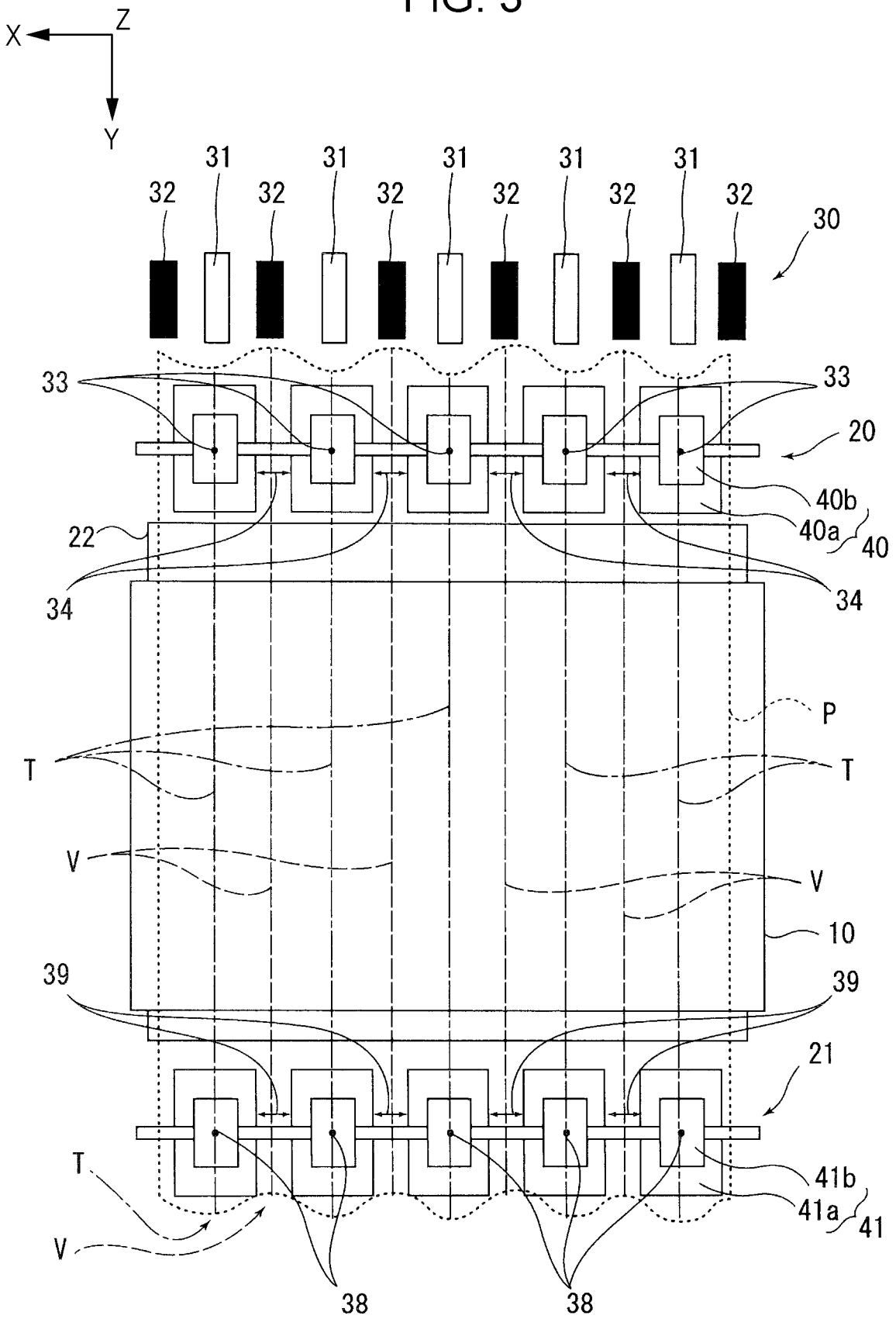
FIG. 3 is a schematic plan diagram of the periphery of the recording unit.
Figure 4:
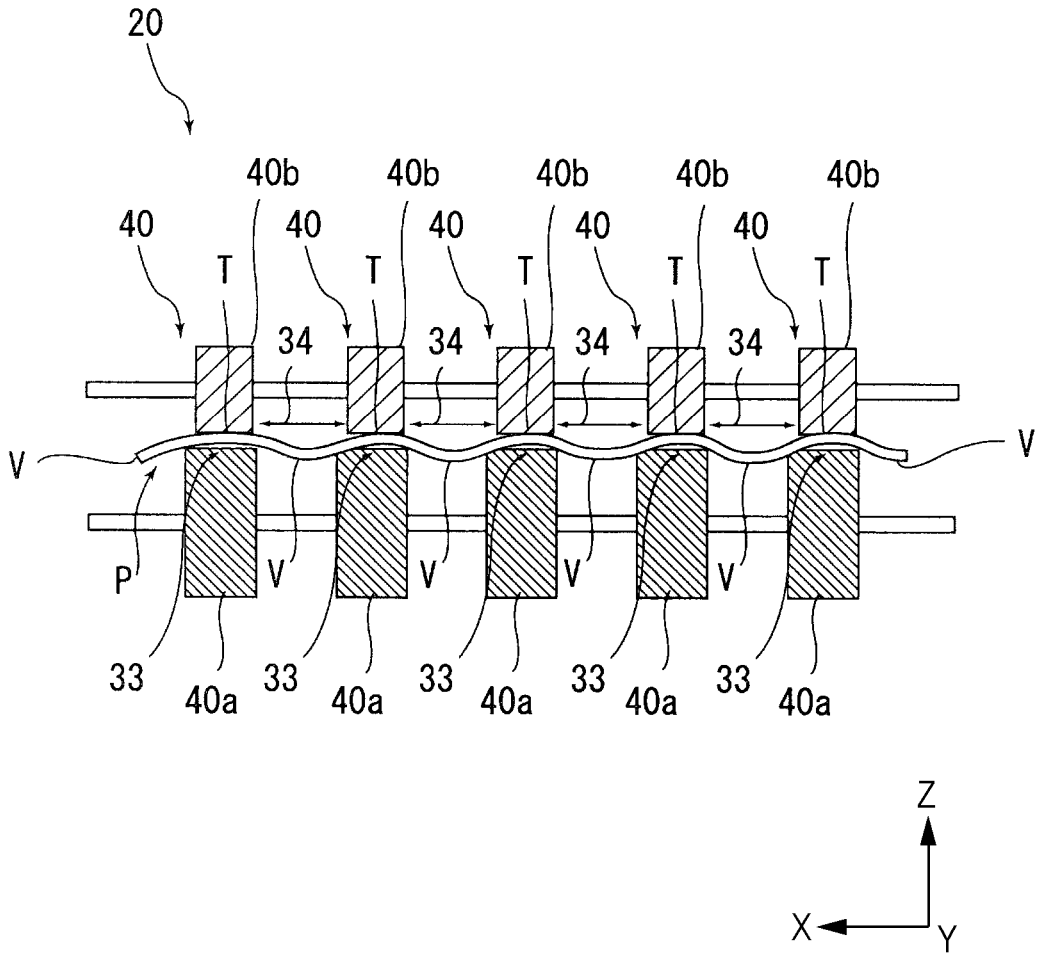
FIG. 4 is a sectional diagram of a Z-X plane of an upstream-side transport unit according to Example 1.
Figure 5:
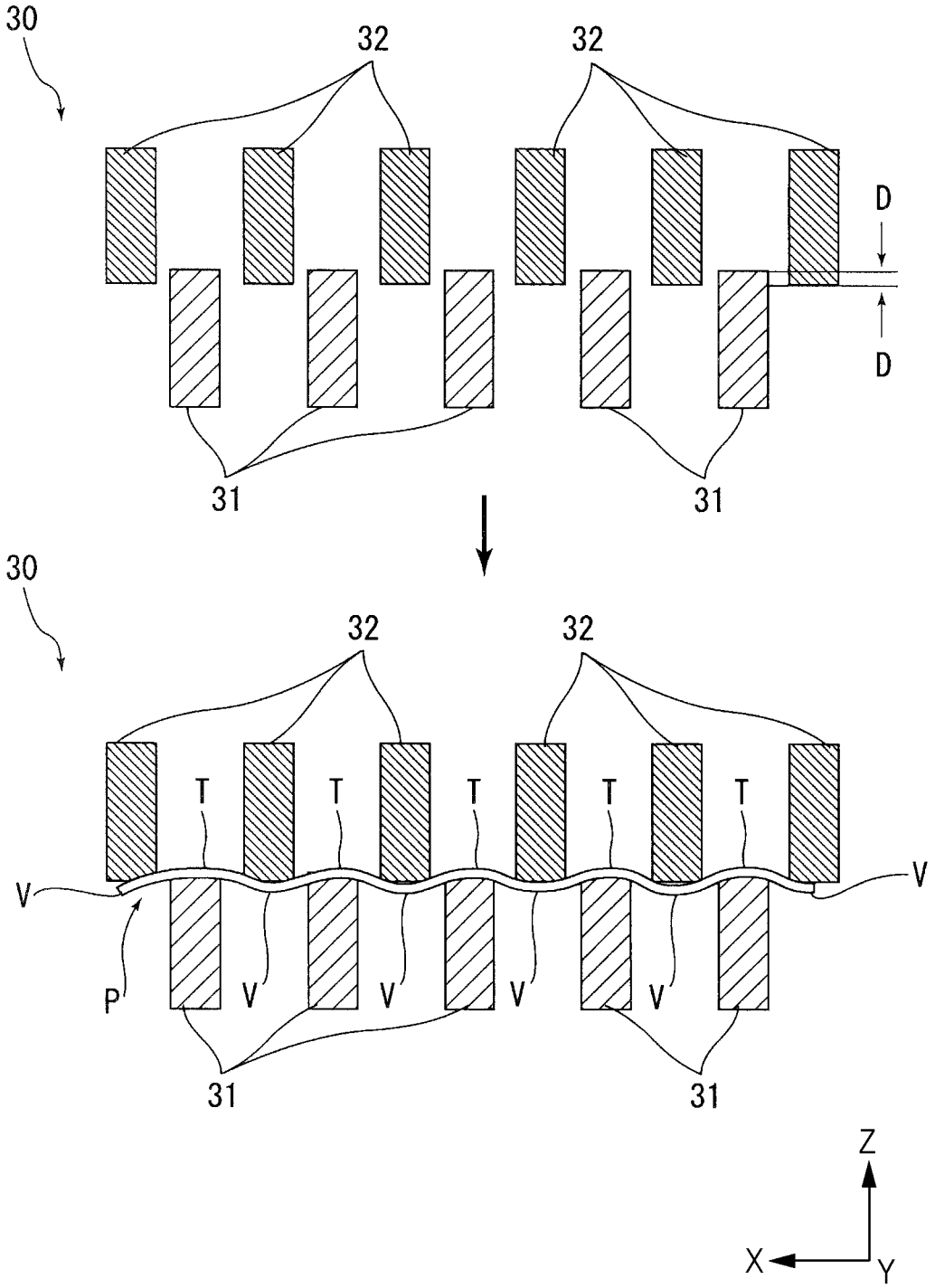
FIG. 5 is a sectional diagram of a Z-X plane of a forming unit according to Example 1.
Figure 6:
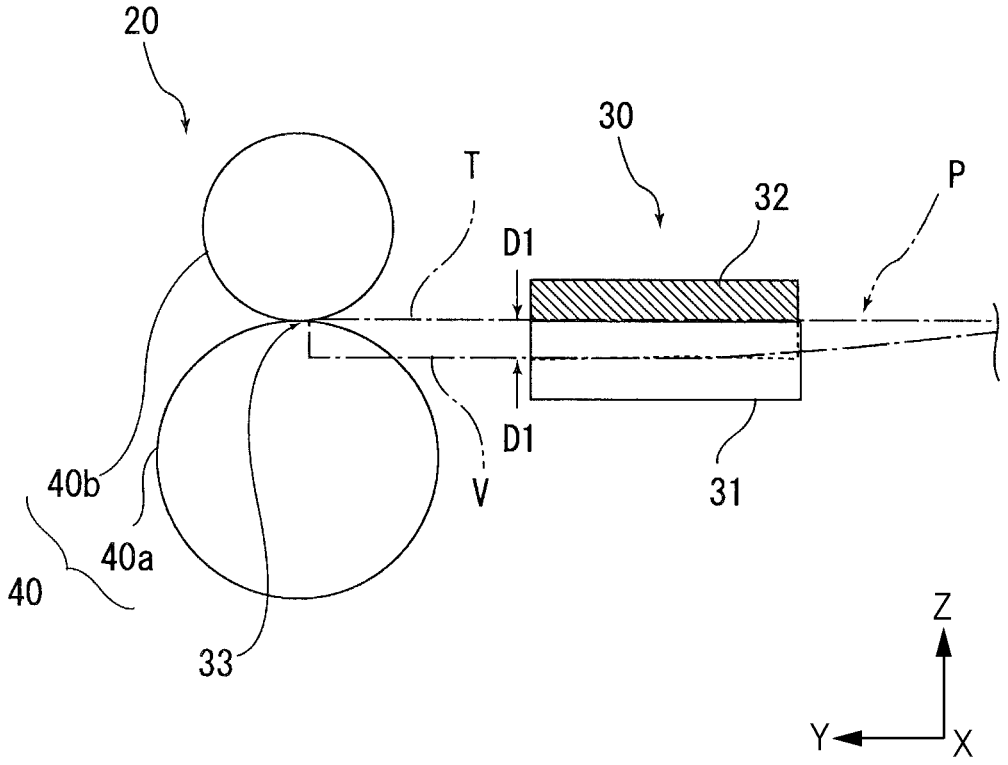
FIG. 6 is a diagram explaining a positional relationship between the upstream-side transport unit and the forming unit in a height direction.

FIG. 1 is a schematic diagram illustrating a paper transport path in a printer. FIG. 2 is a schematic lateral diagram of a periphery of a recording unit. FIG. 3 is a schematic plan diagram of the periphery of the recording unit. FIG. 4 is a sectional diagram of a Z-X plane of an upstream-side transport unit according to Example 1. FIG. 5 is a sectional diagram of a Z-X plane of a forming unit according to Example 1. FIG. 6 is a diagram explaining a positional relationship between the upstream-side transport unit and the forming unit in a height direction.

Figure 7:
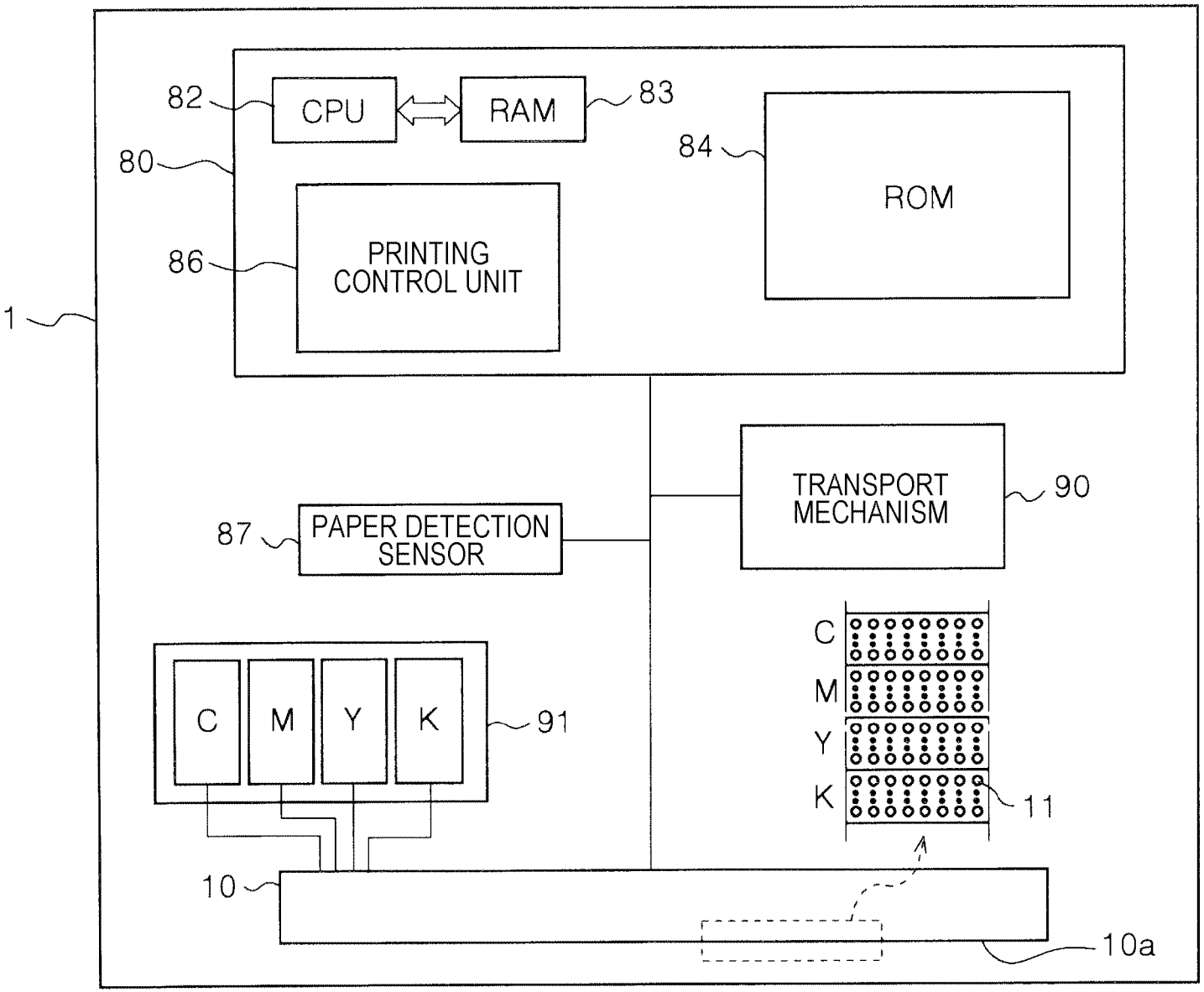
FIG. 7 is a block diagram illustrating a control system of the printer according to the disclosure.
Figure 8:
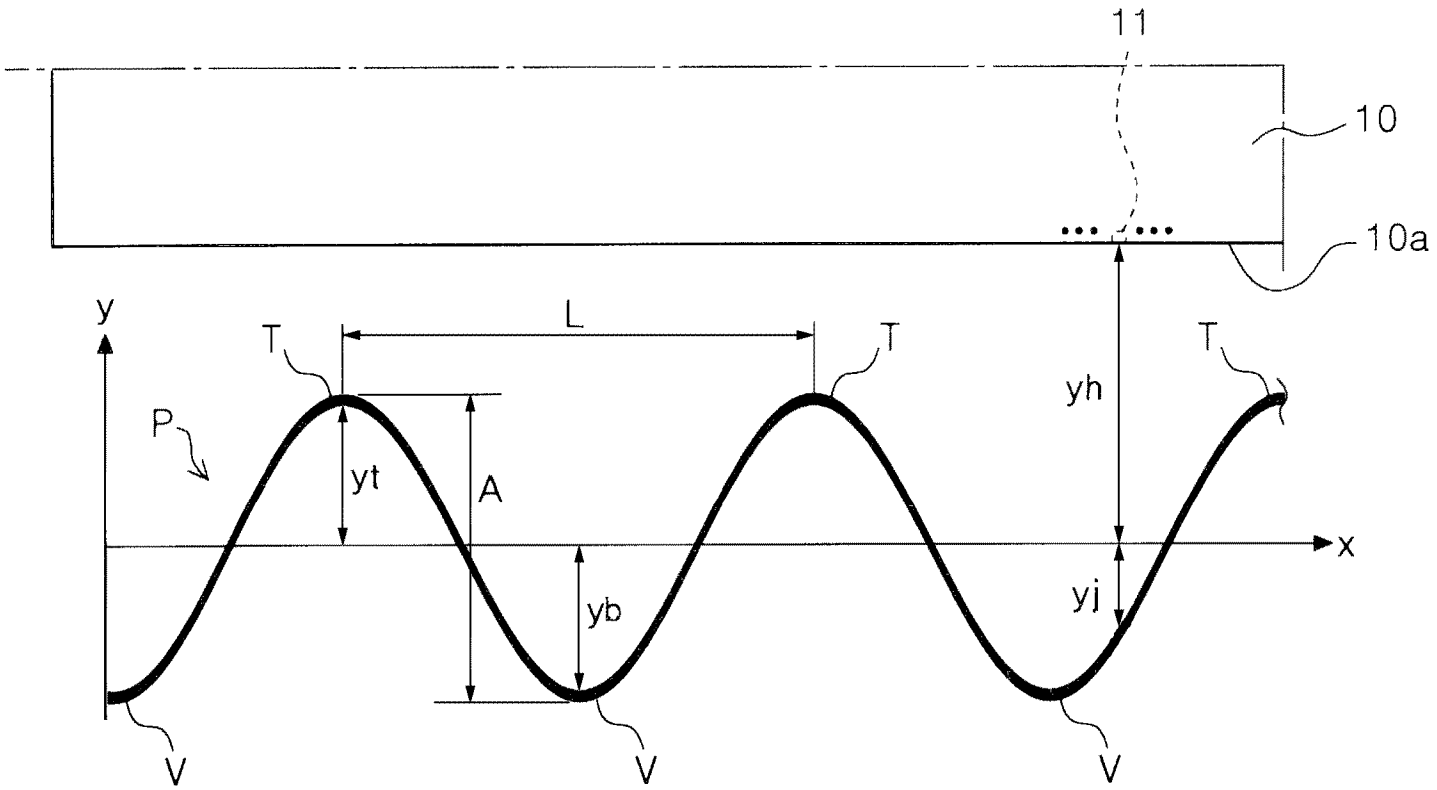
FIG. 8 is a diagram illustrating a corrugation shape and equations which obtain the same.
Figure 9:
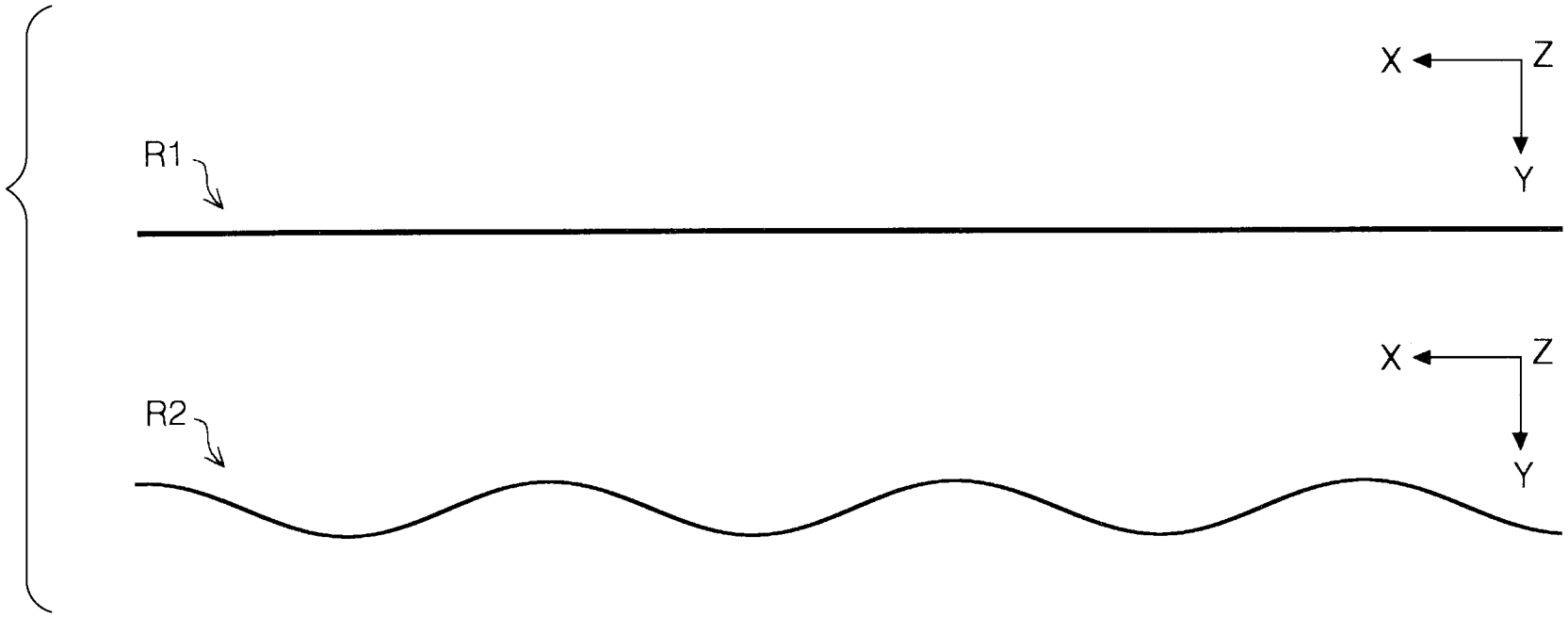
FIG. 9 is a diagram illustrating a rendering result when the line is rendered in the paper.
Figure 10:
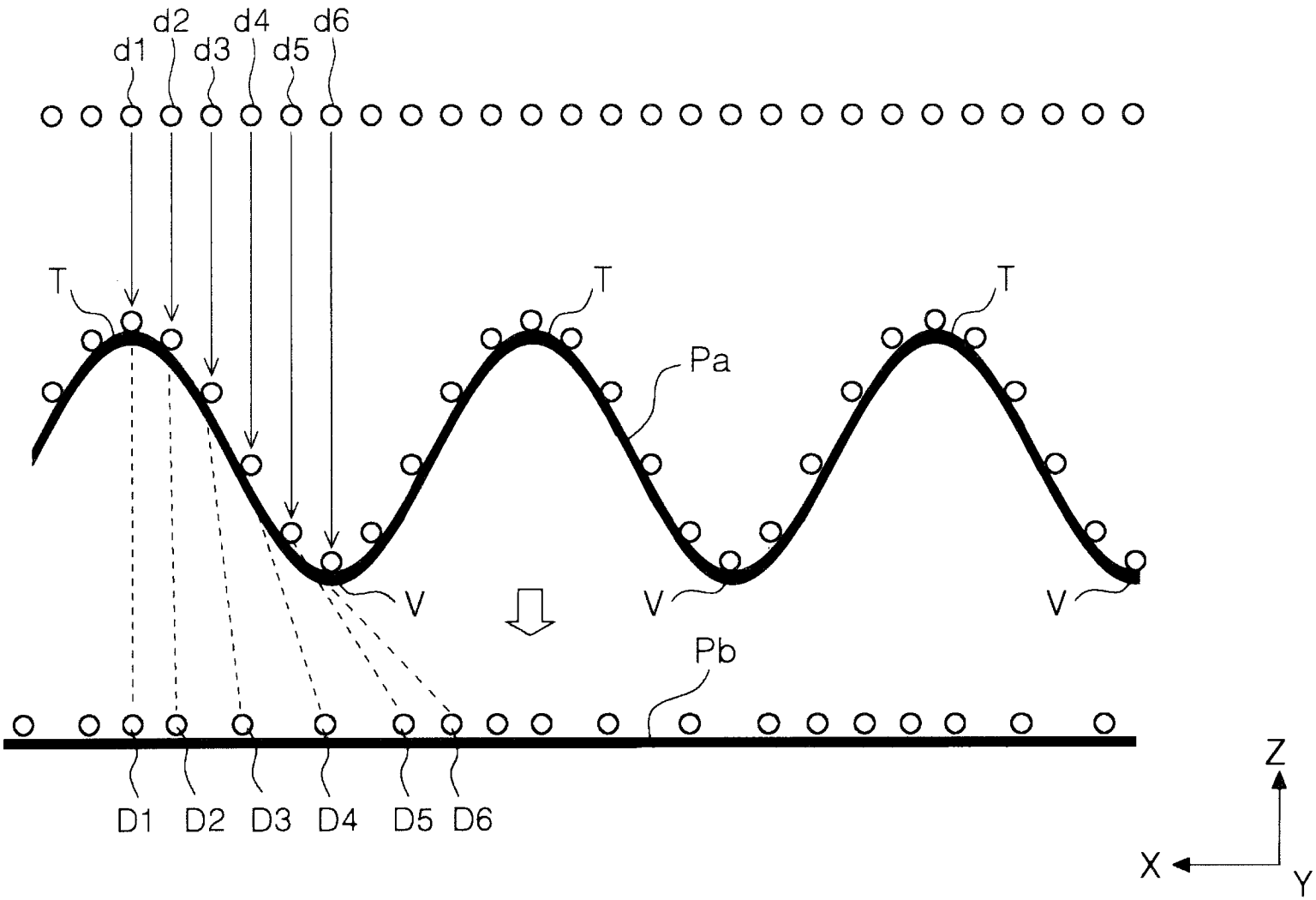
FIG. 10 is a diagram schematically illustrating a dot forming state when ink droplets are discharged onto the paper in which the corrugation is formed.

FIG. 7 is a block diagram illustrating a control system of the printer according to the disclosure, FIG. 8 is a diagram illustrating a corrugation shape and equations which obtain the same, FIG. 9 is a diagram illustrating a rendering result when the line is rendered in the paper, and FIG. 10 is a diagram schematically illustrating a dot forming state when ink droplets are discharged onto the paper in which the corrugation is formed.

Figure 11:
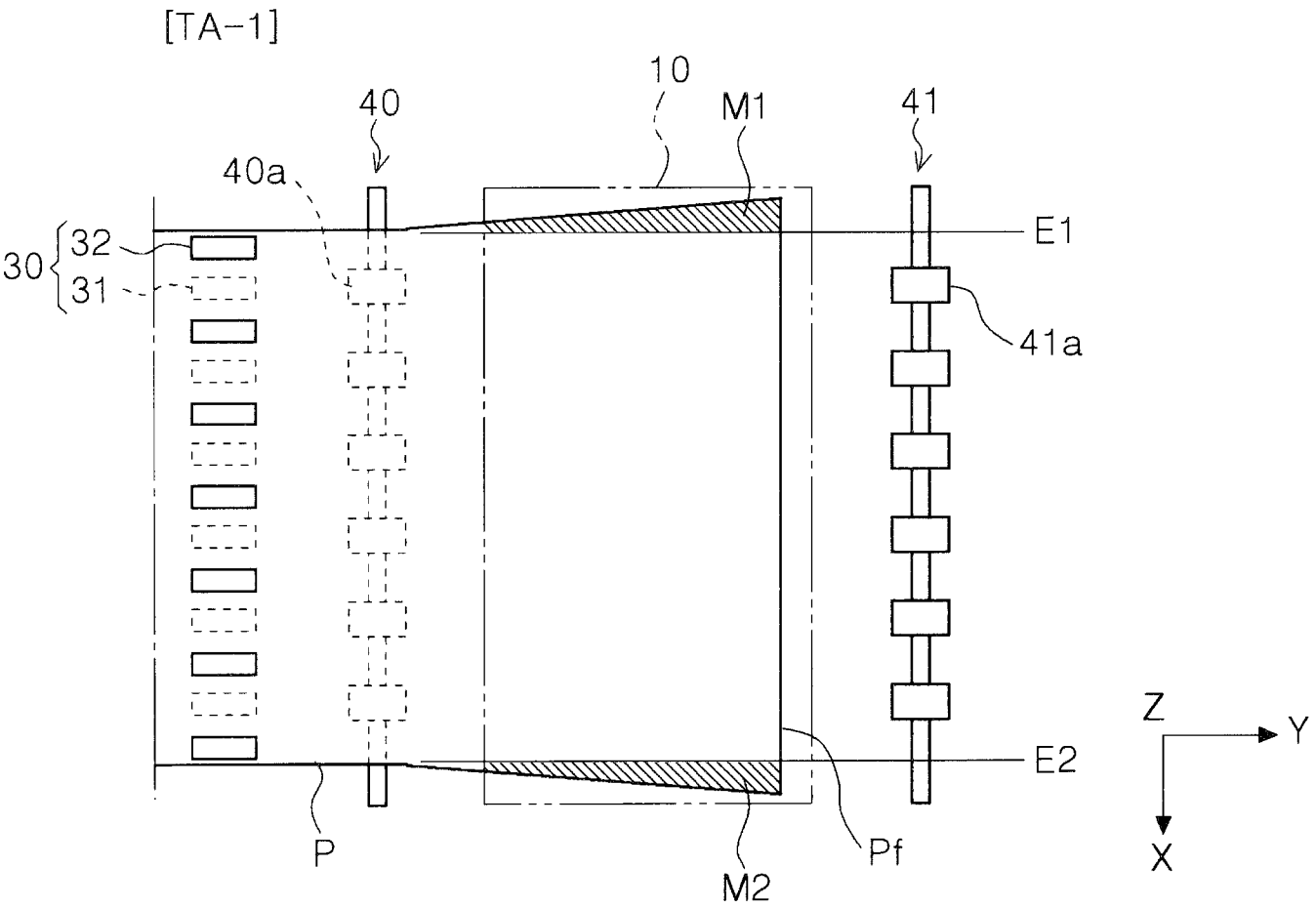
FIG. 11 is a schematic plan diagram of the periphery of the recording unit (a first state of a case in which there is a single forming unit).
Figure 12:
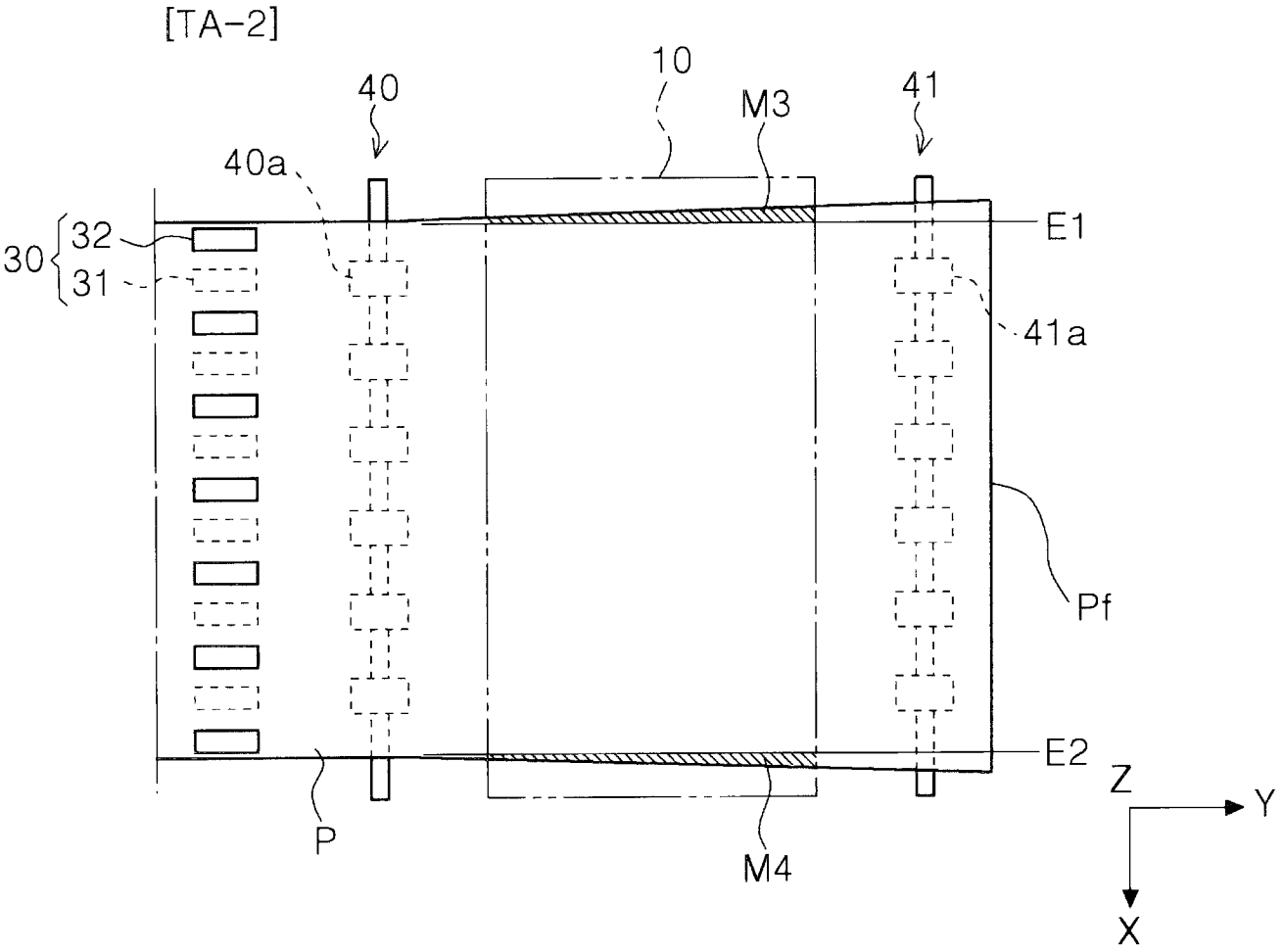
FIG. 12 is a schematic plan diagram of the periphery of the recording unit (a second state of a case in which there is a single forming unit).
Figure 13:
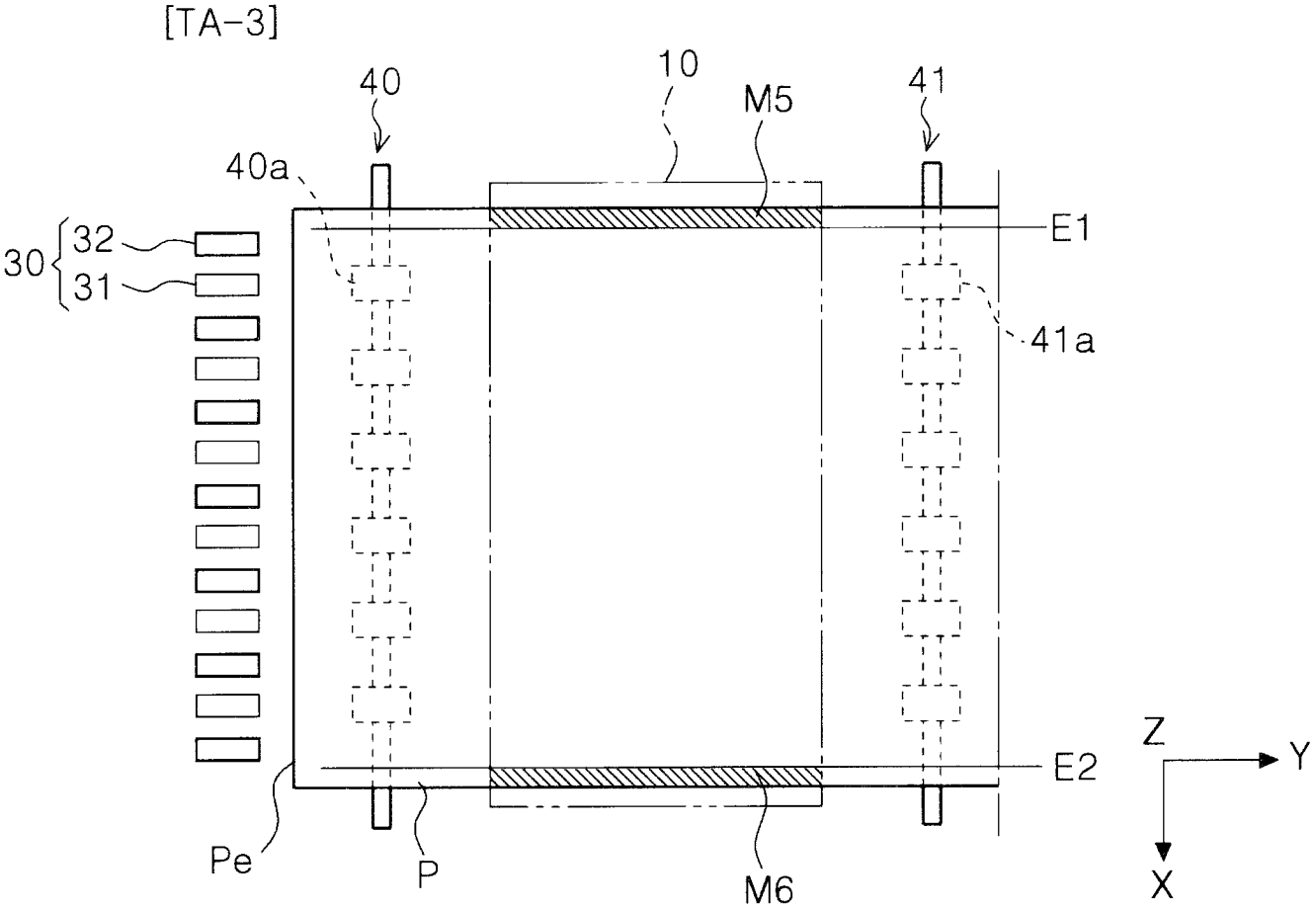
FIG. 13 is a schematic plan diagram of the periphery of the recording unit (a third state of a case in which there is a single forming unit).
Figure 14:
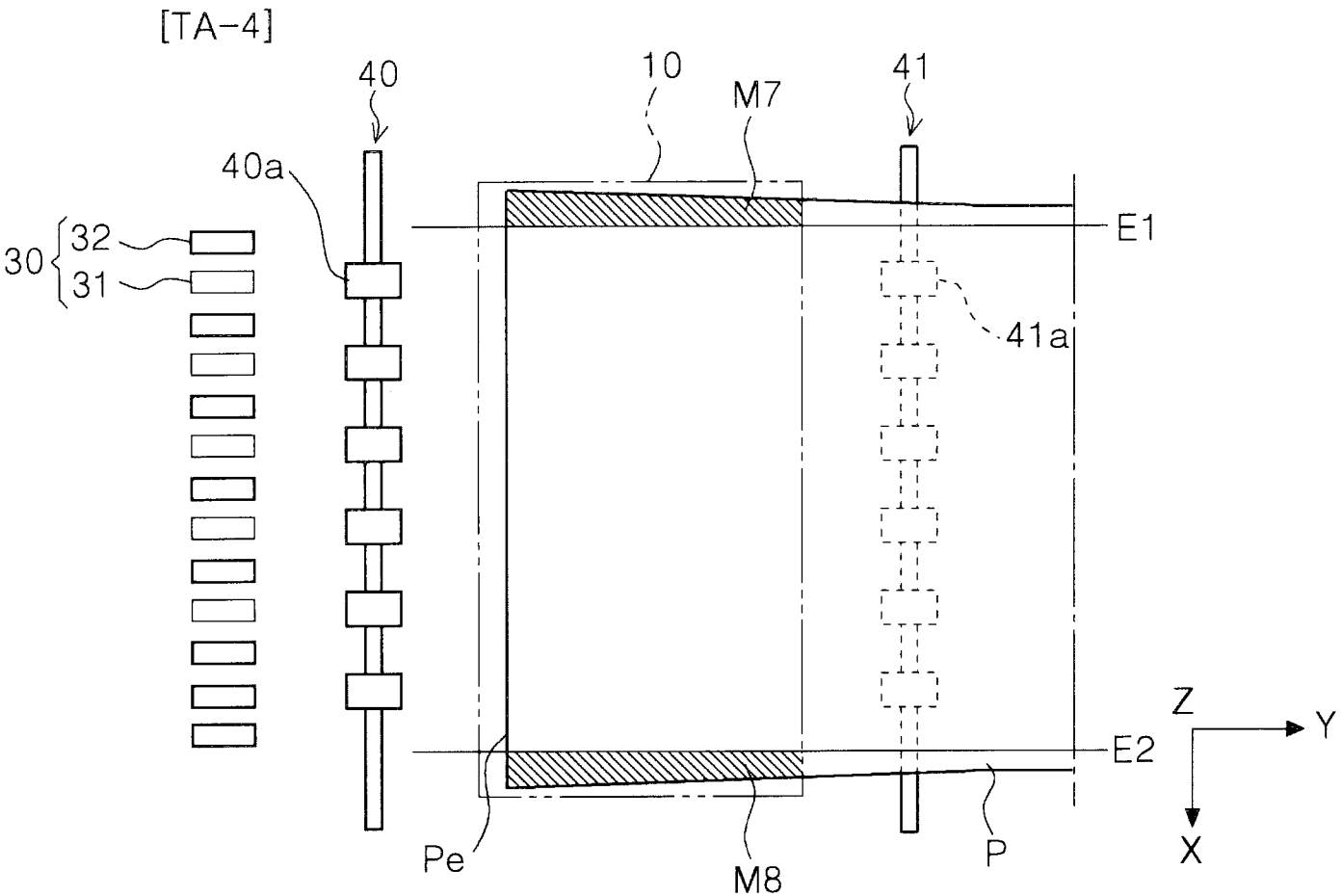
FIG. 14 is a schematic plan diagram of the periphery of the recording unit (a fourth state of a case in which there is a single forming unit).

FIGS. 11 to 14 are schematic plan diagrams of the periphery of the recording unit of a case in which there is a single forming unit in which FIG. 11 illustrates a first state, FIG. 12 illustrates a second state, FIG. 13 illustrates a third state, and FIG. 14 illustrates a fourth state.

Figure 15:
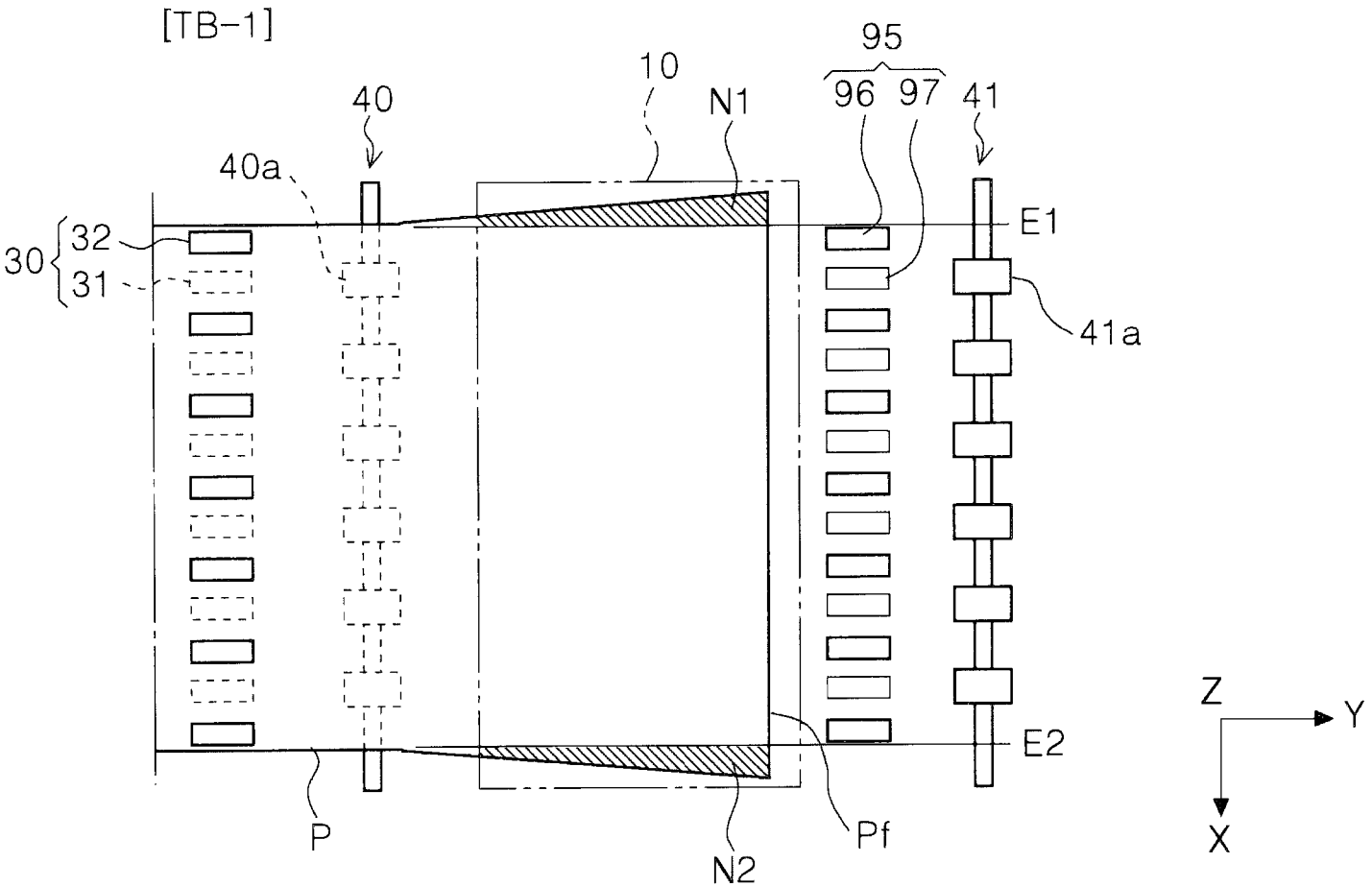
FIG. 15 is a schematic plan diagram of the periphery of the recording unit (a first state of a case in which there are two forming units).
Figure 16:
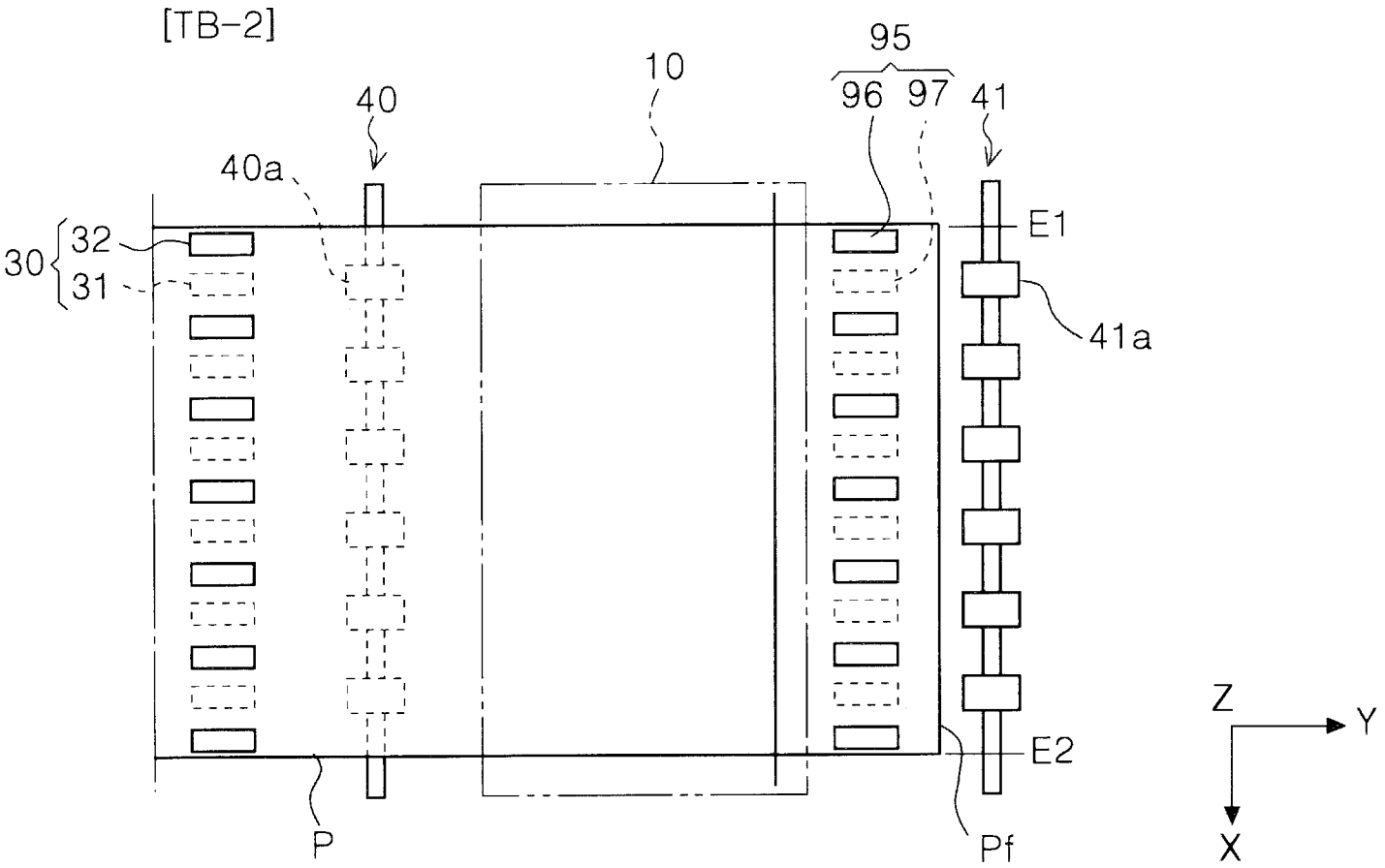
FIG. 16 is a schematic plan diagram of the periphery of the recording unit (a second state of a case in which there are two forming units).
Figure 17:
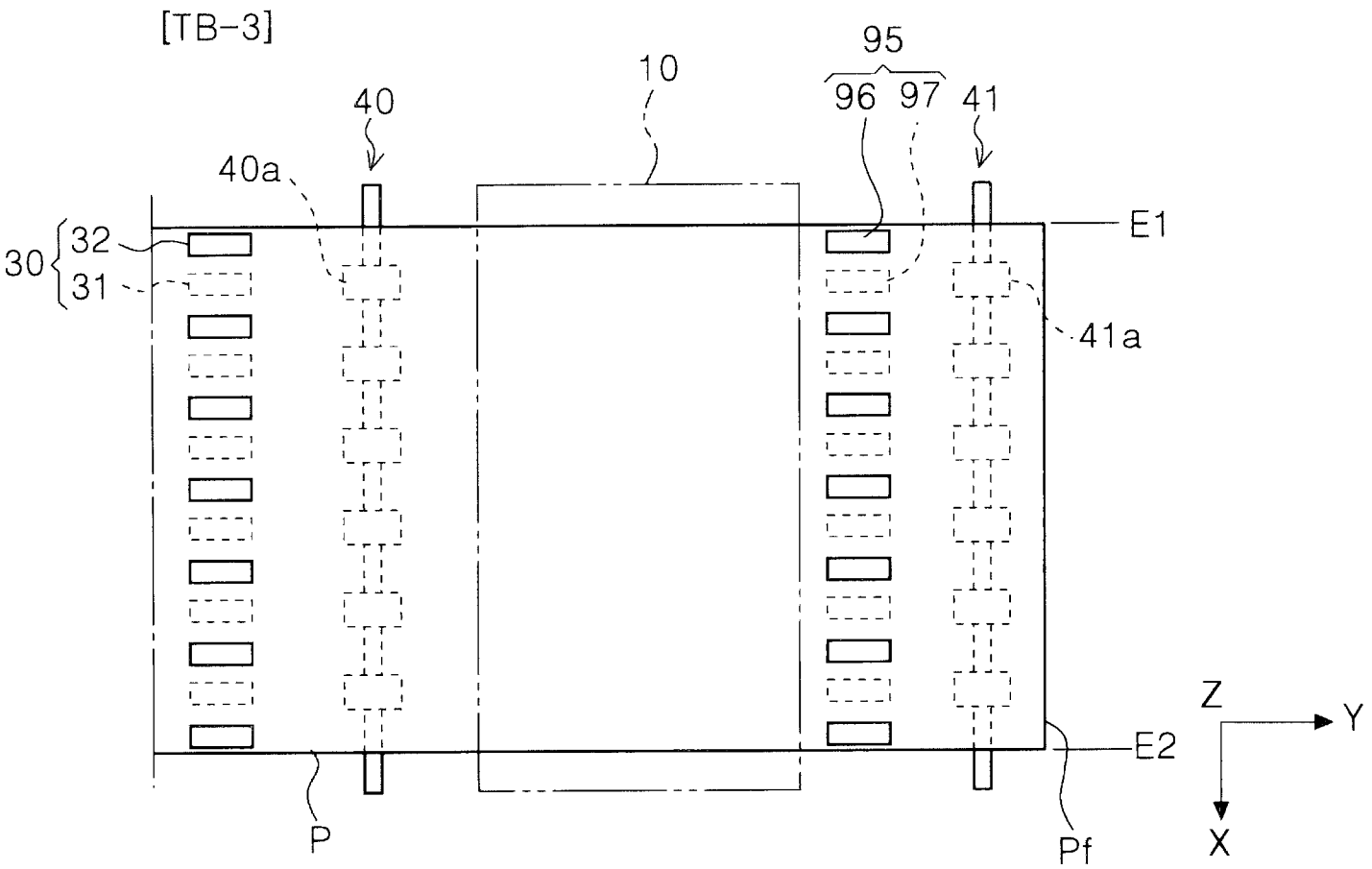
FIG. 17 is a schematic plan diagram of the periphery of the recording unit (a third state of a case in which there are two forming units).
Figure 18:
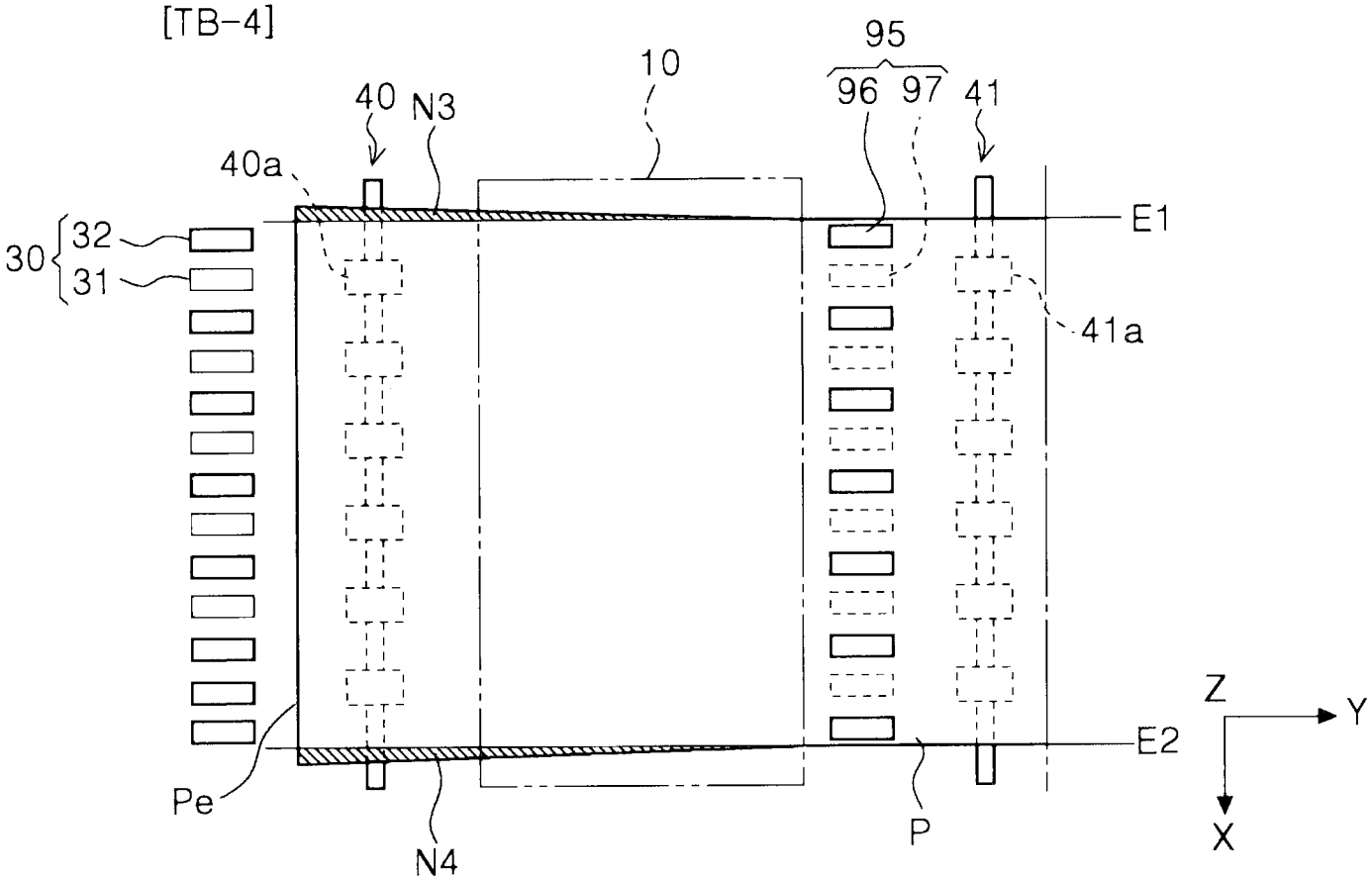
FIG. 18 is a schematic plan diagram of the periphery of the recording unit (a fourth state of a case in which there are two forming units).
Figure 19:
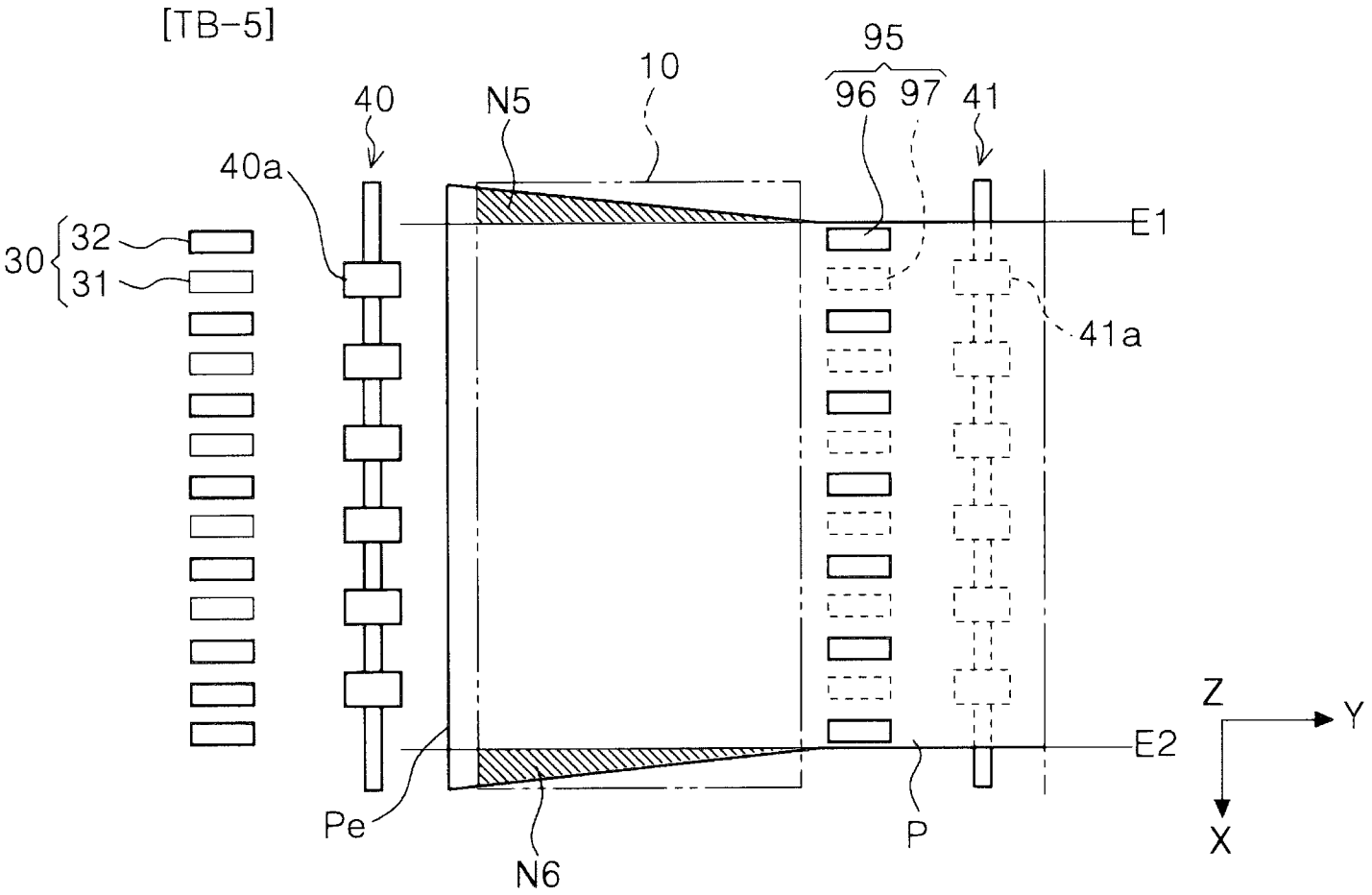
FIG. 19 is a schematic plan diagram of the periphery of the recording unit (a fifth state of a case in which there are two forming units).

FIGS. 15 to 19 are schematic plan diagrams of the periphery of the recording unit of a case in which there are two forming units in which FIG. 15 illustrates a first state, FIG. 16 illustrates a second state, FIG. 17 illustrates a third state, FIG. 18 illustrates a fourth state, and FIG. 19 illustrates a fifth state.

Figure 20:
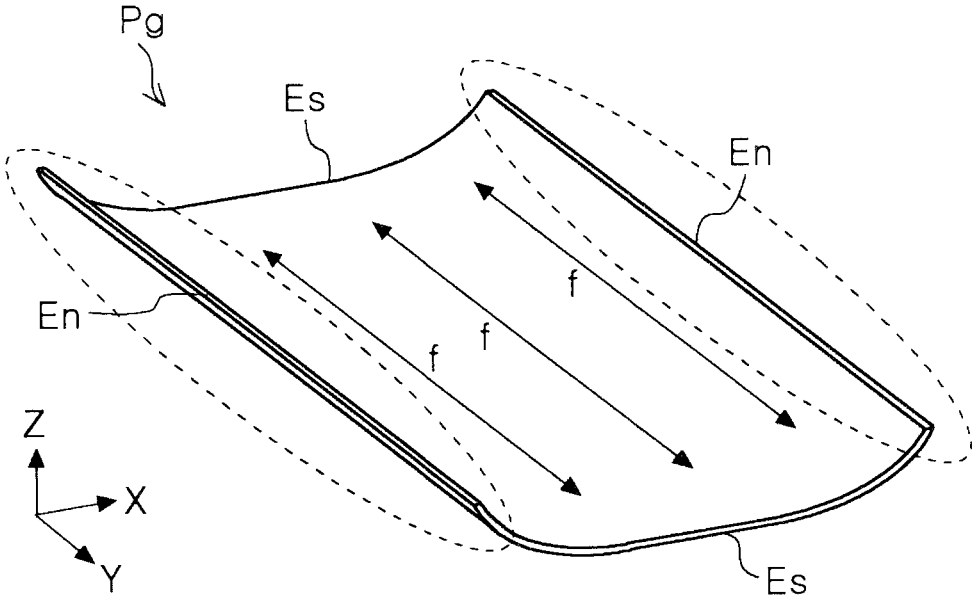
FIG. 20 is a perspective view illustrating an example of a curling state of vertical strand paper.
Figure 21:
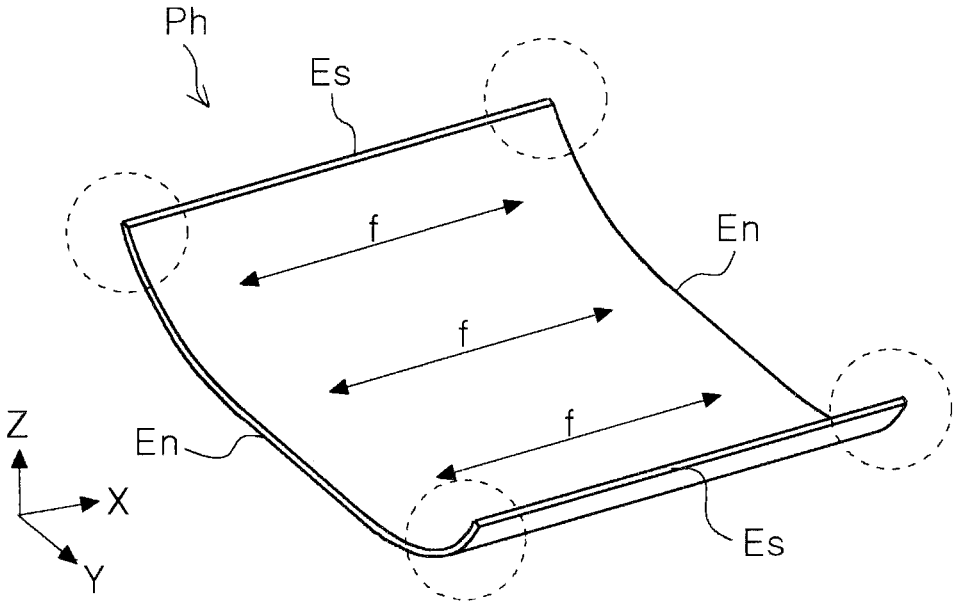
FIG. 21 is a perspective view illustrating an example of a curling state of horizontal strand paper.

Furthermore, FIG. 20 is a perspective view illustrating an example of a curling state of vertical strand paper, and FIG. 21 is a perspective view illustrating an example of a curling state of horizontal strand paper.

In the X-Y-Z coordinate system illustrated in the drawings, an X-axis direction is a width direction of the document and indicates an apparatus depth direction, a Y-axis direction is a transport direction (a medium transport direction) of the paper in the transport path inside the recording apparatus and indicates an apparatus width direction, and a Z-axis direction indicates an apparatus height direction. A direction in which the paper is transported is referred to as downstream and the opposite direction is referred to as upstream.

Outline of Printer

The printer 1 illustrated in FIG. 1 includes a line head 10 which is provided in the inner portion of the apparatus main body 2 and serves as an example of "a recording unit" which discharges a liquid onto paper, which serves as an example of "a medium", to perform recording. In the present embodiment, the liquid is a water-based ink such as an aqueous ink.

The printer 1 is configured such that it is possible to perform duplex recording in which after recording onto a first surface (also referred to as an obverse surface) of the paper, the paper is inverted and recording onto a second surface (also referred to as a reverse surface) is performed.

A plurality of paper storage cassettes 7 are provided on the apparatus bottom portion of the printer 1. The paper which is stored in the paper storage cassettes 7 is fed toward the line head 10 and the recording operation is performed. A configuration is adopted in which, after the recording by the line head 10, the paper is output to either a first output portion 8 or a second output portion 9. The first output portion 8 is for stacking the paper on a first medium placement portion 3 which is provided above the line head 10 and the second output portion 9 is for stacking the paper on a second medium placement portion 4 which is provided on a side surface of the +Y-axis direction side.

Regarding Transport Path of Printer

Next, a description will be given of the transport path of the paper in the printer 1 with reference to FIG. 1. Hereinafter, after describing the transport path which outputs the paper as it is after the recording onto the first surface, a description will be given of the transport path when performing duplex recording.

A plurality of sheets of paper can be stored in a paper storage cassette 7 and the topmost sheet of paper is transported in a feed path 14 (illustrated with a thick solid line in FIG. 1) of the downstream side in the medium transport direction.

The feed path 14 is provided with, in order along the medium transport direction, a feed roller 17 and a separation roller pair 18 which separates the plurality of sheets of paper into single sheets.

The feed roller 17 is configured to be rotationally driven by a drive source (not illustrated). The separation roller pair 18 is also referred to as retarding rollers and is configured to include a drive roller 18*b* which feeds the paper toward a straight path 12 (illustrated by a dashed line in FIG. 1) which is described later and a driven roller 18*a* which nips and separates the paper between the drive roller 18*b* and the driven roller 18*a*.

The topmost sheet of the paper which is stored in the paper storage cassette 7 is picked up by the feed roller 17 and is transported to the downstream side. At this time, although there is a case in which the next sheet or more of the paper is also transported with the top sheet of the paper, the topmost sheet of the paper and the following sheet or more of the paper are separated by the separation roller pair 18 and only the topmost sheet of the paper is fed to the feed path 14.

A resist roller pair 19 is provided on the downstream side of the separation roller pair 18 in the transport direction.

In the present example, the feed path 14 and the straight path 12 are connected at the position of the resist roller pair 19.

The straight path 12 is configured as a path which extends in a substantially straight line shape and an upstream-side transport unit 20, the line head 10, and a downstream-side transport unit 21 are provided on the downstream side of the resist roller pair 19. The straight path 12 includes a recording region K (FIG. 2) of the line head 10.

The upstream-side transport unit 20 is a transport direction which is provided on the upstream side of the line head 10 in the medium transport direction. The downstream-side transport unit 21 is a transport direction which is provided on the downstream side of the line head 10 in the medium transport direction.

A medium support unit 22 is disposed in a region facing the head surface of the line head 10. The medium support unit 22 supports the paper from the opposite side to the recording surface.

A forming unit 30 is provided on the upstream side of the upstream-side transport unit 20 in the medium transport direction. The forming unit 30 is a constituent member which forms a wave shape in which first convex portions T and second convex portions V, which extend in the medium transport direction, are positioned alternately along the width direction which intersects the medium transport direction in a paper P (refer to FIG. 3) which is transported.

The paper P in which the wave shape is formed is given firmness, the rigidity is increased, and the posture of the paper P on the medium support unit 22 is stabilized. Therefore, favorable recording image quality may be obtained in the recording by the line head 10.

The specific configuration of the upstream-side transport unit 20, the downstream-side transport unit 21, and the forming unit 30 will be described in detail later.

The line head 10 is configured such that the ink (the liquid) is ejected onto a recording surface of the paper to execute the recording when the paper is transported to the recording region K (FIG. 2) which faces the line head 10 on the medium support unit 22. The line head 10 is a recording head in which ink discharge nozzles 11 (FIG. 7) which discharge the ink are provided to cover the entire width of the paper, and is configured as a recording head capable of recording on the entire width of the medium with no accompanying movement in the medium width direction.

In addition to a case in which the paper which is stored in the paper storage cassette 7 is fed and the recording is performed, the printer 1 is configured to be capable of feeding paper from a manual tray 5. A dotted line R in FIG. 1 illustrates the transport path of a case in which the paper is fed from the manual tray 5.

The paper which is fed from the manual tray 5 is fed by a transport roller pair 6 merges at the straight path 12 and the recording by the line head 10 is performed in the same manner as the paper which is fed from the paper storage cassette 7.

Next, the paper on which the recording by the line head 10 is performed is fed from the straight path 12 to either a first output path 13 or a second output path 24 depending on the output destination of the paper after the recording.

The first output path 13 is a curved path which is connected to the straight path 12 on the downstream side of the line head 10 and outputs the paper from the first output portion 8 with the recording surface of the paper facing downward.

The second output path 24 is a path which extends in a straight line as it is from the straight path 12 on the downstream side of the line head 10 and is a path which feeds the paper such that the paper is output from the second output portion 9 with the recording surface of the paper facing upward.

A switching unit 26 such as a guide flap that switches the transport destination of the paper after the recording is provided at a splitting position S1 between the straight path 12, the first output path 13, and the second output path 24. The operations of the switching unit 26 are controlled by a control unit 80. In addition to the transport operation (the driving of the various transport roller pairs and the like) of the paper in the printer 1, the control unit 80 controls operations relating to the recording including the operation of the switching unit 26.

The paper which is allocated by the switching unit 26 and is fed from the straight path 12 to the first output path 13 is transported by a transport roller pair group 23, is output from the first output portion 8, and is placed on the first medium placement portion 3 with the recording surface facing downward.

The paper which is fed from the straight path 12 to the second output path 24 is transported by the transport roller pair 25, is output from the second output portion 9, and is placed on the second medium placement portion 4 with the recording surface facing upward.

Next, a description will be given of the transport path during the duplex recording.

The printer 1 (FIG. 1) is provided with a switchback path 15 and an inverting path 16. The switchback path 15 splits from the straight path 12 on the downstream side of the line head 10 closer to the upstream side (the upstream side of the transport roller pair group 23 in FIG. 1 in the present embodiment) than the first output path 13, and the inverting path 16 is connected to the switchback path 15, inverts the obverse and the reverse (the first surface and the second surface) of the paper, and returns the paper to the straight path 12. A splitting position S2 of the straight path 12 and the switchback path 15 and a connecting portion of the switchback path 15 and the inverting path 16 are provided with guide flaps 36 and 37, respectively, and are configured such that the path in which the paper is fed is switched by the switching of the guide flaps 36 and 37. The operations of the guide flaps 36 and 37 are controlled by the control unit 80.

In a case in which duplex recording is executed in the printer 1, the paper, after recording is performed on the first surface, is fed to the switchback path 15 and is subsequently fed to the inverting path 16. The inverting path 16 is connected to the upstream side of the straight path 12 and the paper which passes through the inverting path 16 and is inverted is fed to the straight path 12 with the second surface facing the line head 10 side. The recording onto the second surface is executed at this point.

The paper in which the recording onto the second surface is performed is allocated by the switching unit 26 and either passes through the first output path 13 and is output from the first output portion 8 or passes through the second output path 24 and is output from the second output portion 9.

Regarding Upstream-Side Transport Unit

Next, a detailed description will be given of the upstream-side transport unit 20. The upstream-side transport unit 20 (FIGS. 2 to 4) is configured to include upstream-side transport roller pairs 40 which serve as "transport roller pairs" which nip and transport the paper P and are provided with upstream-side drive rollers 40*a* which are driven by a drive source (not illustrated) and upstream-side driven rollers 40*b*.

As described earlier, the forming unit 30 is provided on the upstream side of the upstream-side transport unit 20 and the paper P, in which the wave shape in which the first convex portions T (the mountain portions T) which extend along the medium transport direction and are convex on one surface of the medium and the second convex portions V (the valley portions V) which extend along the medium transport direction and are convex on the other surface of the medium are positioned alternately along the width direction which intersects the medium transport direction is formed, is nipped by the upstream-side transport unit 20.

Here, when roller pairs which are cylindrical in the width direction are used as the upstream-side transport unit 20, for example, there is a concern that the roller pair will have an effect in a direction which erases the wave shape such as evening or crushing the wave shape when the paper P is nipped.

Therefore, the upstream-side transport unit 20 (FIGS. 3 and 4) of the present embodiment is configured such that nipping portions 33 and escape portions 34 are disposed alternately along the width direction. The nipping portions 33 nip one of the first convex portions T and the second convex portions V, and the escape portions 34 allow the other of the first convex portions T and the second convex portions V that are not being nipped to escape.

Specifically, as illustrated in FIGS. 3 and 4, the plurality of roller pairs are configured to be disposed leaving an interval in the width direction (the X-axis direction) which intersects the medium transport direction.

In FIG. 4, a state is illustrated in which the nipping portions 33 of the upstream-side transport roller pairs 40 nip the first convex portions T of the wave shape of the paper P and the wave shape is maintained without being crushed due to the second convex portions V of the paper P escaping to the escape portions 34.

The following operations and effects may be obtained by the upstream-side transport unit 20 which is configured in this manner.

In other words, it is possible to suppress the action of the upstream-side transport unit 20 in a direction that erases the wave shape which is formed by the forming unit 30. In other words, it is possible to transport the paper P while maintaining the wave shape that is formed by the forming unit 30 in a favorable manner, and so, it is possible to obtain more favorable recording quality.

In addition to a configuration of the upstream-side transport unit 20 in which individual roller pairs (the upstream-side transport roller pairs 40) are provided leaving intervals therebetween and the intervals are used as the escape portions as in the present embodiment, for example, a configuration may be adopted in which, assuming the roller pairs which are provided to extend in the width direction are configured to include portions (with large diameters) that nip the paper and portions (with small diameters) that do not nip the paper, the portions that do not nip the paper are used as the escape portions.

Regarding Downstream-Side Transport Unit

The downstream-side transport unit 21 (FIGS. 2 and 3) has substantially the same configuration as the upstream-side transport unit 20 which is described earlier. In other words, the downstream-side transport unit 21 is provided with downstream-side transport roller pairs 41 which serve as "output roller pairs" which include downstream-side drive rollers 41*a* which are driven by a drive source (not illustrated) and downstream-side driven rollers 41*b* and nips and transports the paper P. The downstream-side transport unit 21 is configured such that the plurality of roller pairs are disposed leaving an interval in the width direction (the X-axis direction) which intersects the medium transport direction (FIG. 3).

In other words, the downstream-side transport unit 21 (FIG. 3) is configured such that nipping portions 38 and escape portions 39 are disposed alternately along the width direction. When the paper P is nipped, the nipping portions 38 nip one of the first convex portions T and the second convex portions V, and the escape portions 39 allow the other of the first convex portions T and the second convex portions V that are not being nipped by the nipping portions 38 to escape.

When roller pairs which are cylindrical in the width direction are used as the downstream-side transport unit 21, for example, the wave shape of the paper P which is nipped by the downstream-side transport unit 21 is evened, and as a result, the wave shape which is formed in the paper P is apt to return to the original shape toward the downstream side even between the upstream-side transport unit 20 and the downstream-side transport unit 21. Accordingly, there is a case in which the wave shape of the paper P which is transported in the recording region K changes and influences the recording image quality of the paper P.

Due to the downstream-side transport unit 21 being formed by the nipping portions 38 and the escape portions 39 being alternately disposed along the width direction in the same manner as in the upstream-side transport unit 20, it is possible to more effectively maintain the wave shape of the paper P in the recording region K which is positioned between the upstream-side transport unit 20 and the downstream-side transport unit 21.

As illustrated in FIG. 3, the nipping portions 33 in the upstream-side transport unit 20 (the upstream-side transport roller pairs 40) and the nipping portions 38 in the downstream-side transport unit 21 (the downstream-side transport roller pairs 41) are disposed in corresponding positions in the width direction.

Accordingly, it is possible to still more effectively maintain the wave shape of the paper P in the region between the upstream-side transport unit 20 and the downstream-side transport unit 21 (in particular, the recording region K of the line head 10 illustrated in FIG. 2).

Regarding Forming Unit

Hereinafter, a description will be given of the forming unit 30 with reference to FIGS. 2 to 6.

The forming unit 30 is a constituent member which forms a wave shape in which the first convex portions T (illustrated with dot-dash lines in FIG. 3) and the second convex portions V (illustrated with dashed lines in FIG. 3), which extend in the medium transport direction (the Y-axis direction), are positioned alternately along the width direction (the X-axis direction) which intersects the medium transport direction in the paper P.

In the present embodiment, the forming unit 30 is provided on the upstream side of the upstream-side transport unit 20 as described earlier (FIGS. 2 and 3).

As illustrated in FIG. 5, the forming unit 30 is provided with retaining portions 32 and support ribs 31. The retaining portions 32 serve as a plurality of "first contact portions" which contact a first surface side facing the line head 10 in the paper P, and the support ribs 31 serve as a plurality of "second contact portions" which contact a second surface side which is the opposite surface to the first surface in the paper P. The retaining portions 32 and the support ribs 31 are configured to be disposed alternately leaving an interval in the width direction (refer to FIG. 3), and the retaining portions 32 and the support ribs 31 are provided such that portions of the end portion sides of each that contact the paper P overlap in a normal line direction (the apparatus height direction Z in the present embodiment) with respect to the surface of the paper P. In the present embodiment, as illustrated in the top portion of FIG. 5, the end portions (the bottom portions) of the retaining portions 32 and the end portions (the top portions) of the support ribs 31 overlap at the portion of a reference numeral D.

As in the bottom portion of FIG. 5, when the paper P is transported between the retaining portions 32 and the support ribs 31, the paper P is pushed downward by the retaining portions 32 by a pushing amount of the reference numeral D while being supported by the support ribs 31. The portions of the paper P which are supported by the support ribs 31 form the first convex portions T, the portions of the retaining portions 32 which are pushed form the second convex portions V, and the wave shape is formed in the paper P.

It is desirable for the retaining portions 32 and the support ribs 31 to be formed by a material with a low friction coefficient (for example, POM). The wave shape of the paper P is formed by the paper being pushed by the retaining portions 32 when the paper P enters between the retaining portions 32 and the support ribs 31. At this time, the paper P moves in small increments in the width direction. Due to the retaining portions 32 and the support ribs 31 being formed by low friction coefficient members, it is possible to reduce the resistance when forming the wave shape in the paper P.

In the present embodiment, the support ribs 31 are provided in positions corresponding to the upstream-side transport roller pairs 40 in the width direction (the X-axis direction).

Accordingly, the first convex portions T of the wave shape which is formed in the paper P are nipped by the nipping portions 33 of the upstream-side transport roller pairs 40.

As illustrated in FIG. 6, the support ribs 31 are arranged such that the positions of the nipping portions 33 and the positions of the peak portions of the first convex portions T are aligned in the normal line direction (the Z-axis direction) with respect to the surface of the paper P.

Due to the height positions of the nipping portions 33 and the positions of the peak portions of the first convex portions T being aligned, it is possible to cause the upstream-side transport roller pairs 40 which serve as the upstream-side transport unit 20 to smoothly nip the paper P which has the wave shape.

When the positions of the nipping portions 33 of the upstream-side transport roller pairs 40 and the peak portions of the first convex portions T which are formed by the forming unit 30 deviate in the height direction, the paper P is pulled in the height direction of the deviation between the nipping portions 33 of the upstream-side transport roller pairs 40 and the forming unit 30 and there is a concern that the wave shape will be canceled out. However, it is possible to achieve a configuration in which this concern is avoided and the wave shape is easily maintained.

It is not necessary for the height positions of the nipping portions 33 and the positions of the peak portions of the first convex portions T to completely match, for example, as long as the error is of an extent that falls within the radius of the rollers (for example, the upstream-side driven rollers 40*b*) of the upstream-side transport roller pairs 40 from the nipping portions 33, it is possible to transport the paper P while appropriately forming and maintaining the wave shape.

The forming unit 30 is configured by the retaining portions 32 being disposed at the end portion, in the width direction, of the paper of a predetermined size (for example, a standard size which is predefined such as A3, A4, B4, B5, legal, and letter) (FIG. 3). For example, in FIG. 3, when the paper P is A3 (vertical) size, the retaining portions 32 are disposed at the positions of the end portions of both sides in the width direction (also refer to the bottom portion of FIG. 5).

Accordingly, as illustrated in the bottom portion of FIG. 5, it is possible to form a wave shape in which the end portion of the paper P in the width direction faces downward, that is, faces a direction which distances from the line head 10. Therefore, it is possible to reduce the concern of the end portion of the paper P in the width direction contacting the line head 10.

Due to the forming unit 30 being provided on the upstream side of the upstream-side transport unit 20 as in the present embodiment, it is possible to reliably feed the paper P in which the wave shape is formed by the forming unit 30 to the upstream-side transport unit 20 and to achieve a configuration in which the upstream-side transport unit 20 easily maintains the wave shape and transports the paper P.

In addition to a case in which "the forming unit" forms both "the first contact portions (the retaining portions 32" and "the second contact portions (the support ribs 31)" in a rib shape as in the forming unit 30 of the present example, it is possible to configure one or both of "the first contact portions" and "the second contact portions" as rollers which contact the paper P and passively rotate. The same applies to a downstream-side forming unit 95 which is described later.

Control System of Printer 1

Next, a description will be given of the control system of the printer 1 with reference to FIG. 7.

The printer 1 includes the control unit 80 for controlling the ink discharging process (the printing process). The control unit 80 is provided with a CPU 82, a RAM 83, a ROM 84, and a printing control unit 86. The printing control unit 86 is a constituent element which is configured using software.

In the control unit 80, the CPU 82 expands program data which is stored in a memory such as the ROM 84 into the RAM 83, and by performing operations according to the program data, firmware for controlling control targets is executed. The firmware is a program for causing the CPU 82 to execute functions such as the printing control unit 86.

Correction data for performing correction (described later) of the ink discharging is stored in the ROM 84.

The printing control unit 86 generates the print data from the image data (the original data). It is possible to input image data from a memory card (not illustrated) which is connected to a memory card slot (not illustrated) of the printer 1.

Alternatively, the print data is generated by a printer driver which is installed on an external computer (not illustrated) which is connected to the printer 1, for example. The control unit 80 is capable of receiving the print data from the external computer.

The printing control unit 86 generates the drive signal for driving the line head 10, a transport mechanism 90, and the like based on the print data.

As described with reference to FIGS. 1 and 2, the transport mechanism 90 is configured by a motor (not illustrated) or the like which drives the rollers which perform the paper feeding and the transporting of the paper P.

The control unit 80 controls the transport mechanism 90 and the like based on the detection signal of a paper detection sensor 87. As illustrated in FIG. 2, the paper detection sensor 87 is an optical sensor which is provided in the vicinity of the upstream side of the forming unit 30, for example, and transmits a detection signal to the control unit 80 based on the passage of the leading end or the rear end of the paper. Based on the detection signal of the paper detection sensor 87, the control state of the transport mechanism 90, and the paper size information that is acquired based on the driver information, the control unit 80 is capable of ascertaining the position of the paper P, in particular, the state (the contact state) of the interrelationship between the paper P and the rollers, the state (the contact state) of the interrelationship between the paper P and the forming unit 30, and the like.

Although the printer 1 is also provided with paper detection sensors at other positions on the paper transport path, the description thereof will be omitted here.

The printer 1 is provided with an ink tank unit 91 which is provided with a plurality of ink tanks.

In the example of FIG. 7, ink tanks corresponding to C (cyan), M (magenta), Y (yellow), and K (black) inks are stored in the ink tank unit 91. The ink tank unit 91 is connected to the line head 10 and the colored inks are supplied from the ink tank unit 91 to the line head 10.

The line head 10 is provided with ink discharging nozzles 11 which serve as a plurality of "liquid discharging nozzles". In FIG. 7, a portion of the nozzle rows of each of CMYK in a head surface 10*a* of the line head 10 is exemplified inside the range that is surrounded by the dashed line. The nozzle rows of each of CMYK are disposed along the paper transport direction.

Regarding Correction of Ink Discharging onto Paper P in which Wave Shape is Formed Next, a description will be given of the discharging of ink onto the paper P in which the wave shape (the first convex portions T and the second convex portions V) is formed with reference to FIGS. 8 to 10.

As illustrated in FIG. 8, the interval between the paper P in which the wave shape is formed and the head surface 10*a* of the line head 10 changes in the paper width direction (the X direction). In a case in which a predetermined position in the X direction is set to an origin point (X=0), the wave shape which is formed in the paper P can be represented by a sine function such as that illustrated in Equation (2) of FIG. 8. In Equation (2), yj indicates a height component of the landing position of the ink when the ink is discharged from the ink discharging nozzles 11 at a position X.

In FIG. 8, yt is a height component of the first convex portion T, yb is a depth component of the second convex portion V, L indicates a period of the mountains, and A in Equation (2) is a value obtained by subtracting the average value of yb from the average value of yt (Equation 1). In Equation (1), yt and yb which have overlines indicate the average values of yt and yb, respectively. In the same manner, in Equation (2), L which has an overline indicates the average value of L.

Here, it is possible to acquire the average values of yt, yb, and L by actually performing the ink discharging on the paper P. For example, lines R1 and R2 illustrated in FIG. 9 illustrate rendering results when the ink discharging is performed from the ink discharging nozzles 11 which are lined up in a straight line along the X direction in order to render a straight line in a direction (the X direction) orthogonally intersecting the medium transport direction (the Y direction) with respect to the paper P.

The line R1 is the rendering result when the ink discharging is performed with respect to the paper P (the paper P in which the recording surface is a flat surface) in a state in which the wave shape (the first convex portions T and the second convex portions V) is not formed and, as illustrated, the line R1 forms a completely straight line.

In comparison, the line R2 is the rendering result when the ink discharging is performed with respect to the paper P in which the wave shape (the first convex portions T and the second convex portions V) is formed and, as illustrated, the line R2 draws a sine curve. This is because the time until the ink which is discharged from the ink discharging nozzles 11 facing the first convex portions T lands is shorter than that of the ink which is discharged from the ink discharging nozzles 11 facing the second convex portions V and the ink discharging is performed with respect to the paper P in a state in which the paper P is transported in the Y direction.

Therefore, it is possible to obtain the averages of yt, yb, and L based on the sine curve of the line R2.

This is an example, and, naturally, it is possible to measure the wave shape which is formed in the paper P using a measuring device such as a laser distance meter, for example.

Next, returning to FIG. 8, when the height component of the ink discharging nozzles 11 is yh and the discharge speed of the ink is V, it is possible to obtain an ink landing time T using Equation (3).

Therefore, when the ink is discharged by a certain ink discharging nozzle 11, it is possible to cause the ink which is discharged from the ink discharging nozzles 11 to land at the same timing by delaying the ink discharge timing by the difference between the ink landing time T of the ink discharging nozzle 11 and Tmax, which is the greatest among the nozzles.

Specifically, when the ink discharge timing (the ink discharge time) that serves as Tmax of the ink discharging nozzle 11 is used as a reference timing S, the ink discharge timing (the ink discharge time) S of the ink discharging nozzle 11 at a position n in the X direction is represented by Equation (4).

As described above, by correcting the ink discharge timing (the ink discharge time), a favorable recording result may be obtained with respect to the paper P in which the wave shape is formed.

In the present embodiment, the correction of the ink discharge timing which is described above is undertaken by the printing control unit 86 illustrated in FIG. 7. The parameters illustrated in FIG. 8 which are necessary for the correction of the ink discharge timing are stored in the ROM (FIG. 7) which serves as an example of a memory unit.

The parameters which are necessary for the correction of the ink discharge timing may be acquired and held for every type of the paper.

As described above with reference to FIGS. 2 and 3, the printer 1 according to the present embodiment is provided with the line head 10, the upstream-side transport roller pairs 40, the downstream-side transport roller pairs 41, and the forming unit 30. The line head 10 serves as a liquid discharge unit which is provided with a plurality of the ink discharging nozzles 11 which discharge the ink onto the paper P which is transported, the upstream-side transport roller pairs 40 are provided on the upstream side in the paper transport direction with respect to the line head 10, the downstream-side transport roller pairs 41 are provided on the downstream side in the paper transport direction with respect to the line head 10, and the forming unit 30 forms the wave shape in which the first convex portions T and the second convex portions V which extend in the paper transport direction (the Y direction) are positioned alternately along the paper width direction (the X direction) which intersects the paper transport direction in the paper P. The upstream-side transport roller pairs 40 are transport roller pairs which nip and transport the paper P and are formed by the nipping portions 33 which nip the first convex portions T and the escape portions 34 which allow the second convex portions V to escape being disposed alternately along the paper width direction.

Therefore, it is possible to suppress the action of the upstream-side transport roller pairs 40 and the downstream-side transport roller pairs 41 in a direction which cancels out the wave shape which is formed by the forming unit 30, it is possible to transport the paper P while maintaining the wave shape which is formed by the forming unit 30 in a favorable manner, and so, it is possible to obtain more favorable recording quality.

Since the control unit 80 (FIG. 7) which controls the discharging of the ink of the ink discharging nozzles 11 controls the discharging of the ink of the ink discharging nozzles 11 according to the shape of the paper P between the upstream-side transport roller pairs 40 and the downstream-side transport roller pairs 41, even if the paper P deforms between the upstream-side transport roller pairs 40 and the downstream-side transport roller pairs 41, it is possible to obtain favorable recording quality due to the ink being discharged according to the deformation.

When the ink is discharged onto the paper P in which the wave shape is formed, more favorable recording results may be obtained by also performing the following correction.

FIG. 10 schematically illustrates a landing state when the ink is discharged onto a paper Pa in which the wave shape is formed and reference numerals d1 to d6 illustrate a portion of the ink droplets which are discharged by the line head 10.

The ink droplets d1 to d6 are discharged at an equal interval in the X direction, land at an equal interval in the X direction with respect to the paper Pa in which the wave shape is formed, and form dots D1 to D6, respectively. However, the interval of the dots which are adjacent in the first convex portions T and the second convex portions V is greater than the interval of the dots which are adjacent between the first convex portions T and the second convex portions V.

A paper Pb schematically illustrates a state in which the paper Pa in which the wave shape is formed is smoothed into a flat shape and when the wave shape of the paper Pa which is subjected to recording and is output is canceled out, for example, the paper Pa becomes the paper Pb.

In the paper Pb, for example (in the paper Pa), since the space between the first convex portion T and the second convex portion V forms an inclined surface, the interval between the dot D3 and the dot D4 which are formed by the ink droplet d3 and the ink droplet d4 which are discharged in this region is wider than the interval between the dot D1 and the dot D2 which are formed by the ink droplet d1 and the ink droplet d2 which are discharged on the first convex portion T or the interval between the dot D5 and the dot D6 which are formed by the ink droplet d5 and the ink droplet d6 which are discharged on the second convex portion V.

Accordingly, density irregularities are generated in the recording result and the recording quality is reduced.

The control unit 80 (FIG. 7) executes control which renders the ink discharge amount with respect to positions between the first convex portions T and the second convex portions V greater than the ink discharge amount with respect to the first convex portions T and the second convex portions V. In the example of FIG. 10, the ink droplets d3 and d4 are greater than the ink droplets d1, d2, d5, and d6. Accordingly, it is possible to increase the density between the first convex portions T and the second convex portions V, that is, a more appropriate recording quality may be obtained by suppressing the density irregularities.

Alternatively, when the control unit 80 (FIG. 7) forms the plurality of dots through the discharging of the ink droplets along the paper width direction (the X direction), the ink discharging nozzles 11 which are used when forming the dots on the first convex portions T and the second convex portions V may be thinned. In the example of FIG. 10, for example, the ink droplets d1 and d6 are not discharged. Accordingly, it is possible to render the dot interval at the first convex portions T and the second convex portions V the same as or closer to the dot interval at the positions between the first convex portions T and the second convex portions V, and so, the density irregularities may be suppressed to obtain more appropriate recording quality.

When the wave shape is formed in the paper P by the forming unit 30, the size of the paper P in the paper width direction (the X direction) is contracted. Therefore, it is favorable to configure the control unit 80 (FIG. 7) such that the size of the recording region in the paper width direction based on the recording data is contracted to correspond to the paper width which is contracted by the forming unit 30. Accordingly, it is possible to avoid the ink being discharged at positions at which the paper is not present, and it is possible to suppress fouling of the apparatus by the ink.

In a case in which the size of the recording region in the paper width direction based on the recording data is contracted to correspond to the paper width which is contracted by the forming unit 30, it is possible to adopt at least one method of a method of contracting the overall recording region and a method of discarding the end portions of the recording region.

Case in which Single Forming Unit is Provided

It is also favorable for the control unit 80 (FIG. 7) to control the ink discharging according to changes in the interrelationship (the contact state) of the paper P with relation to the upstream-side transport roller pairs 40 and the downstream-side transport roller pairs 41 illustrated in FIGS. 11 to 14 or the like, and further according to changes in the interrelationship (the contact state) of the paper P with respect to the forming unit 30.

FIG. 11 illustrates a first state TA-1 in which the paper P is in contact with the forming unit 30 and the upstream-side transport roller pairs 40 and a leading end Pf does not reach the downstream-side transport roller pairs 41.

FIG. 12 illustrates a second state TA-2 in which the paper P is in contact with the forming unit 30, the upstream-side transport roller pairs 40, and the downstream-side transport roller pairs 41.

FIG. 13 illustrates a third state TA-3 in which a rear end Pe of the paper P leaves the forming unit 30 and is in contact with the upstream-side transport roller pairs 40 and the downstream-side transport roller pairs 41.

FIG. 14 illustrates a fourth state TA-4 in which the rear end Pe of the paper P leaves the upstream-side transport roller pairs 40 and is in contact with the downstream-side transport roller pairs 41.

In FIGS. 11 to 14, reference numerals E1 and E2 illustrate paper edge positions (width direction edge positions: hereinafter referred to as "reference edge positions") at the position of the forming unit 30. The reference edge positions E1 and E2 are positioned closer to the inside than the width direction edge positions of the paper P in a case in which the wave shape is not formed.

In the first state TA-1 illustrated in FIG. 11, since the influence received by the paper P from the forming unit 30 weakens toward the leading end Pf, and further, the leading end Pf side is not restricted by the downstream-side transport roller pairs 41, the paper shape (the paper shape when the paper is viewed from the normal line direction with respect to the recording surface) spreads out toward the downstream side and the width direction edge positions are closer to the outside than the reference edge positions E1 and E2. The regions which are given diagonal hatching illustrated by reference numerals M1 and M2 illustrate regions that overhang from the reference edge positions E1 and E2 to the outside in the width direction in the region facing the line head 10.

Therefore, in the first state TA-1, the control unit 80 (FIG. 7) uses those of the ink discharging nozzles 11, which are used during a predetermined dot forming, that are closer to the outside in the paper width direction going toward the downstream side in the paper transport direction. In other words, the range of the ink discharging nozzles 11 to be used is expanded toward the downstream side. In other words, the ink discharging nozzles 11 to be used are selected such that the ink discharging is also performed on the overhanging regions M1 and M2. Alternatively, the size and the shape of the print data is adjusted such that the ink discharging is also performed on the overhanging regions M1 and M2.

Next, in the second state TA-2 illustrated in FIG. 12, since the influence on the paper P which is received from the forming unit 30 weakens going toward the leading end Pf in the same manner as in the first state TA-1 illustrated in FIG. 11, the paper shape spreads out toward the downstream side and the width direction edge positions are closer to the outside than the reference edge positions E1 and E2. The regions which are given diagonal hatching illustrated by reference numerals M3 and M4 illustrate regions that overhang from the reference edge positions E1 and E2 to the outside in the width direction.

However, unlike in the first state TA-1 illustrated in FIG. 11, since the leading end Pf side is restricted by the downstream-side transport roller pairs 41, the spreading out is gentler than in the first state TA-1. Incidentally, the overhanging regions M3 and M4 are smaller than the overhanging regions M1 and M2 illustrated in FIG. 11.

Therefore, in the same manner as in the first state TA-1, in the second state TA-2 illustrated in FIG. 12, those of the ink discharging nozzles 11, which are used during a predetermined dot forming, that are closer to the outside in the paper width direction going toward the downstream side in the paper transport direction are used. In other words, the range of the ink discharging nozzles 11 to be used is expanded toward the downstream side. In other words, the ink discharging nozzles 11 to be used are selected such that the ink discharging is also performed on the overhanging regions M3 and M4. Alternatively, the size and the shape of the print data is adjusted such that the ink discharging is also performed on the overhanging regions M3 and M4.

Next, in the third state TA-3 illustrated in FIG. 13, since the paper P is not influenced equally by the upstream-side transport roller pairs 40 and the downstream-side transport roller pairs 41 in a state in which the paper P is not influenced by the forming unit 30, both edges in the width direction become parallel. However, since the wave shape which is formed in the paper P is maintained, as much as possible, by the upstream-side transport roller pairs 40 and the downstream-side transport roller pairs 41, both edges in the width direction are closer to the outside than the reference edge positions E1 and E2. The regions which are given reference numerals M5 and M6 illustrate the overhanging regions.

Therefore, regarding the ink discharging nozzles 11 to be used during the predetermined dot forming, the control unit 80 (FIG. 7) uses those which have the same position in the width direction. However, the ink discharging nozzles 11 to be used are selected such that the ink discharging is also performed on the overhanging regions M5 and M6. Alternatively, the size and the shape of the print data is adjusted such that the ink discharging is also performed on the overhanging regions M5 and M6.

Next, in the fourth state TA-4 illustrated in FIG. 14, since the rear end Pe side of the paper P is not restricted by the upstream-side transport roller pairs 40, the paper shape spreads out toward the upstream side and the width direction edge positions are closer to the outside than the reference edge positions E1 and E2. The regions which are given diagonal hatching illustrated by reference numerals M7 and M8 illustrate regions that overhang from the reference edge positions E1 and E2 to the outside in the width direction.

Therefore, in the fourth state TA-4, the control unit 80 (FIG. 7) uses those of the ink discharging nozzles 11, which are used during a predetermined dot forming, that are closer to the outside in the paper width direction going toward the upstream side in the paper transport direction. In other words, the range of the ink discharging nozzles 11 to be used is expanded toward the upstream side. In other words, the ink discharging nozzles 11 to be used are selected such that the ink discharging is also performed on the overhanging regions M7 and M8. Alternatively, the size and the shape of the print data is adjusted such that the ink discharging is also performed on the overhanging regions M7 and M8.

As described above, since the control unit 80 (FIG. 7) controls the ink discharging by the ink discharging nozzles 11 according to the contact state of the paper P with respect to the upstream-side transport roller pairs 40 and the downstream-side transport roller pairs 41, favorable recording results may be obtained even if the shape of the paper P changes does to changes in the contact state of the paper P with respect to the upstream-side transport roller pairs 40 and the downstream-side transport roller pairs 41.

Since the control unit 80 controls the ink discharging by the ink discharging nozzles 11 according to the contact state of the paper P with respect to the forming unit 30, favorable recording results may be obtained even if the shape of the paper P changes due to changes in the contact state of the paper P with respect to the forming unit 30.

Specifically, in the present embodiment, due to the control unit 80 controlling the ink discharging by the ink discharging nozzles 11 according to each of the states of the first state TA-1, the second state TA-2, the third state TA-3, and the fourth state TA-4, even if the deformation state of the paper P is different in each of the states, it is possible to obtain favorable recording quality due to the ink being discharged accordingly.

Case in which Two Forming Units are Provided

Incidentally, it is possible to provide the forming unit which forms the wave shape in the paper P not only on the upstream side of the upstream-side transport roller pairs 40 but also on the upstream side of the downstream-side transport roller pairs 41. Even in this case, it is also favorable for the control unit 80 (FIG. 7) to control the ink discharging according to changes in the interrelationship (the contact state) of the paper P with relation to the upstream-side transport roller pairs 40 and the downstream-side transport roller pairs 41 illustrated in FIGS. 15 to 19 or the like, and further according to changes in the interrelationship (the contact state) of the paper P with respect to the forming unit of the upstream side and the forming unit of the downstream side.

In the present embodiment, the forming unit 30 is referred to as "the upstream-side forming unit 30". The downstream-side forming unit 95 is provided on the upstream side of the downstream-side transport roller pair 41. The downstream-side forming unit 95 is configured to include a plurality of retaining portions 96 which contact the first surface side that faces the line head 10 in the paper P, and support ribs 97 which contact the second surface side which is an opposite surface to the first surface in the paper P.

The configuration of the downstream-side forming unit 95 is similar to that of the forming unit (the upstream-side forming unit) 30 which is described above, that is, the retaining portions 96 correspond to the retaining portions 32 and the support ribs 97 correspond to the support ribs 31. Therefore, the description of the detailed configuration of the downstream-side forming unit 95 will be omitted hereinafter.

FIG. 15 illustrates a first state TB-1 in which the paper P is in contact with the upstream-side forming unit 30 and the upstream-side transport roller pairs 40 and the leading end Pf does not reach the downstream-side forming unit 95.

FIG. 16 illustrates a second state TB-2 in which the paper P is in contact with the upstream-side forming unit 30, the upstream-side transport roller pairs 40, and the downstream-side forming unit 95.

FIG. 17 illustrates a third state TB-3 in which the paper P is in contact with the upstream-side forming unit 30, the upstream-side transport roller pairs 40, the downstream-side forming unit 95, and the downstream-side transport roller pairs 41.

FIG. 18 illustrates a fourth state TB-4 in which the rear end Pe of the paper P leaves the upstream-side forming unit 30 and is in contact with the upstream-side transport roller pairs 40, the downstream-side forming unit 95, and the downstream-side transport roller pairs 41.

FIG. 19 illustrates a fifth state TB-5 in which the rear end Pe of the paper P leaves the upstream-side transport roller pairs 40 and is in contact with the downstream-side forming unit 95 and the downstream-side transport roller pairs 41.

In FIGS. 15 to 19, the reference numerals E1 and E2 illustrate the paper edge positions (width direction edge positions: hereinafter referred to as "reference edge positions") at the positions of the upstream-side forming unit 30 and the downstream-side forming unit 95.

In the first state TB-1 illustrated in FIG. 15, since the influence received by the paper P from the upstream-side forming unit 30 weakens toward the leading end Pf, and further, the leading end Pf side does not reach the downstream-side forming unit 95, the paper shape (the paper shape when the paper is viewed from the normal line direction with respect to the recording surface) spreads out toward the downstream side and the width direction edge positions are closer to the outside than the reference edge positions E1 and E2. The regions which are given diagonal hatching illustrated by reference numerals N1 and N2 illustrate regions that overhang from the reference edge positions E1 and E2 to the outside in the width direction.

Therefore, in the first state TB-1, the control unit 80 (FIG. 7) uses those of the ink discharging nozzles 11, which are used during a predetermined dot forming, that are closer to the outside in the paper width direction going toward the downstream side in the paper transport direction. In other words, the range of the ink discharging nozzles 11 to be used is expanded toward the downstream side. In other words, the ink discharging nozzles 11 to be used are selected such that the ink discharging is also performed on the overhanging regions N1 and N2. Alternatively, the size and the shape of the print data is adjusted such that the ink discharging is also performed on the overhanging regions N1 and N2.

Next, in the second state TB-2 illustrated in FIG. 16, since the paper P is influenced equally by the upstream-side forming unit 30 and the downstream-side forming unit 95, both edges in the width direction become parallel. Although the paper P is in contact with the upstream-side transport roller pairs 40, since the influence of the upstream-side forming unit 30 and the downstream-side forming unit 95 is greater, there is no significant influence on the paper shape.

The same applies to the third state TB-3 illustrated in FIG. 17.

Therefore, in the second state TB-2 illustrated in FIG. 16 and the third state TB-3 illustrated in FIG. 17, regarding the ink discharging nozzles 11 to be used during the predetermined dot forming, the control unit 80 (FIG. 7) uses those which have the same position in the width direction.

Next, in the fourth state TB-4 illustrated in FIG. 18, since the rear end Pe side of the paper P leaves the upstream-side forming unit 30, the paper shape spreads out toward the upstream side and the width direction edge positions are closer to the outside than the reference edge positions E1 and E2. The regions which are given diagonal hatching illustrated by reference numerals N3 and N4 illustrate regions that overhang from the reference edge positions E1 and E2 to the outside in the width direction.

Even in the fifth state TB-5 illustrated in FIG. 19, in the same manner as in the fourth state TB-4 illustrated in FIG. 18 above, the paper shape spreads out toward the upstream side. However, the overhang amount (the width direction size) of overhanging regions N5 and N6 in the fifth state TB-5 is smaller than the overhang amount of the overhanging regions N3 and N4 in the fourth state TB-4. This is because in the fifth state TB-5, unlike in the fourth state TB-4, the paper is not restricted by the upstream-side transport roller pair 40.

Therefore, in the fourth state TB-4 and the fifth state TB-5, the control unit 80 (FIG. 7) uses those of the ink discharging nozzles 11, which are used during a predetermined dot forming, that are closer to the outside in the paper width direction going toward the upstream side in the paper transport direction. In other words, the range of the ink discharging nozzles 11 to be used is expanded toward the upstream side. In other words, the ink discharging nozzles 11 to be used are selected such that the ink discharging is also performed on the overhanging regions N3 and N4 or on the overhanging regions N5 and N6. Alternatively, the size and the shape of the print data is adjusted such that the ink discharging is also performed on the overhanging regions N3 and N4 or the overhanging regions N5 and N6.

As described above, by controlling the ink discharging by the ink discharging nozzles 11 according to each of the states of the first state TB-1, the second state TB-2, the third state TB-3, the fourth state TB-4, and the fifth state TB-5, even if the deformation state of the paper P is different in each of the states, it is possible to obtain favorable recording quality due to the ink being discharged accordingly.

Other Examples (1) When the recording is performed on the second surface, which is the surface of the opposite side to the first surface of the paper P on which the recording is first performed, since the rigidity of the paper P changes according to the discharge amount of the ink onto the first surface, there is a case in which the amplitude of the wave shape which is formed in the paper P also changes. For example, since the greater the discharge amount of the ink onto the first surface, the lower the rigidity of the paper P, the amplitude of the wave shape increases.

Therefore, when the control unit 80 (FIG. 7) performs the recording on the second surface, which is the surface of the opposite side to the first surface on which the recording is first performed, it is also favorable to control the ink discharging by the ink discharging nozzles 11 according to the discharge amount of the ink discharging nozzle onto the first surface. Accordingly, still more favorable recording results may be obtained.

Specifically, the parameters which are described with reference to FIG. 8, for example, and are necessary for the correction of the ink discharge timing are acquired and held for each ink discharge amount during the recording onto the first surface for the recording onto the second surface. At this time, it is preferable to further acquire the parameters for every type of the paper.

(2) According to the flow direction of the pulp during the manufacturing of the paper, "flow strands" in which the fibers align with the flow direction are formed in the paper. For example, in FIG. 20, a reference numeral Pg illustrates paper which has long sides En and short sides Es and in which flow strands f are generated along the long side direction, so-called "vertical strand paper". When the ink is discharged onto the vertical strand paper Pg, curling occurs in which the edges (the regions surrounded by dashed lines) of the long sides En warp upward as illustrated in FIG. 20. In a case in which the vertical strand paper Pg which has such curling properties is transported along the long side direction, even if the wave shape is formed by the forming unit, a tendency arises for the edge regions of the long sides En to lift up.

Therefore, due to the control unit 80 (FIG. 7) controlling the ink discharge timing in consideration of such curling, still more favorable recording results may be obtained.

Specifically, for example, it is possible to prepare usage-dedicated correction values for the edge regions of the long sides En in relation to the correction of the ink discharge timing which is described with reference to FIG. 8.

Similarly, a reference numeral Ph in FIG. 21 illustrates paper which has the long sides En and the short sides Es and in which the flow strands f are generated along the short side direction, so-called "horizontal strand paper". When the ink is discharged onto the horizontal strand paper Ph, curling in which the edges of the short sides Es warp upward is generated as illustrated in FIG. 21. In a case in which the horizontal strand paper Ph which has such curling properties is transported along the long side direction, even if the wave shape is formed by the forming unit, a tendency arises for the corner portion regions (the regions surrounded by dashed lines) to lift up.

Therefore, due to the control unit 80 (FIG. 7) controlling the ink discharge timing in consideration of such curling, still more favorable recording results may be obtained.

Specifically, for example, it is possible to prepare usage-dedicated correction values for the corner portion regions in relation to the correction of the ink discharge timing which is described with reference to FIG. 8.

The entire disclosure of Japanese Patent Application No.: 2017-108352, filed on May 31, 2017, is expressly incorporated by reference herein.

What is claimed is:

1. A recording apparatus comprising:

a liquid discharge unit which is provided with a plurality of liquid discharging nozzles which discharge a liquid onto a medium which is transported;

an upstream-side transport unit which is provided on an upstream side of the liquid discharge unit in a medium transport direction;

a downstream-side transport unit which is provided on a downstream side of the liquid discharge unit in the medium transport direction; and a forming unit which is provided on the upstream side of the liquid discharge unit and the upstream-side transport unit in the medium transport direction and forms in the medium, alternately in a width direction which intersects the medium transport direction, first convex portions which extend along the medium transport direction and are convex in one surface of the medium and second convex portions which extend along the medium transport direction and are convex in another surface of the medium, wherein the upstream-side transport unit is a transport roller pair, and a plurality of the transport roller pairs which nip and transport the medium are disposed along the width direction, wherein the transport roller pairs nip either the first convex portions or the second convex portions which are formed in the medium, and wherein a control unit which controls discharging of the liquid of the liquid discharging nozzles controls the discharging of the liquid of the liquid discharging nozzles according to shapes of the first convex portions and the second convex portions which are formed in the medium between the upstream-side transport unit and the downstream-side transport unit.

2. The recording apparatus according to claim 1, wherein the control unit controls the discharging of the liquid of the liquid discharging nozzles according to a contact state of the medium with respect to the upstream-side transport unit or the downstream-side transport unit.

3. The recording apparatus according to claim 1, wherein the control unit controls the discharging of the liquid of the liquid discharging nozzles according to a contact state of the medium with respect to the forming unit.

4. The recording apparatus according to claim 1, wherein the control unit ensures that a discharge amount of the liquid with respect to positions between the first convex portions and the second convex portions is greater than a discharge amount of the liquid with respect to the first convex portions and the second convex portions.

5. The recording apparatus according to claim 1, wherein when forming a plurality of dots on the medium using the discharging of the liquid along the width direction, the control unit thins the liquid discharging nozzles to be used during dot formation onto the first convex portions and the second convex portions.

6. The recording apparatus according to claim 1, wherein the control unit contracts a size of a recording region in the width direction based on recording data corresponding to a width of the medium which is contracted by the forming unit.

7. The recording apparatus according to claim 1, wherein when performing recording on a second surface which is a surface of an opposite side to a first surface of the medium on which recording is first performed, the control unit controls the discharging of the liquid of the liquid discharging nozzles according to a discharge amount of the liquid onto the first surface.

8. The recording apparatus according to claim 1, wherein the control unit controls the discharging of the liquid of the liquid discharging nozzles according to a state corresponding to any one of a first state in which the medium is in contact with the forming unit and the upstream-side transport unit and a leading end of the medium does not reach the downstream-side transport unit, a second state in which the medium is in contact with the forming unit, the upstream-side transport unit, and the downstream-side transport unit, a third state in which a rear end of the medium leaves the forming unit and the medium is in contact with the upstream-side transport unit and the downstream-side transport unit, and a fourth state in which the rear end of the medium leaves the upstream-side transport unit and the medium is in contact with the downstream-side transport unit.

9. The recording apparatus according to claim 8, wherein the liquid discharge unit is provided with a plurality of nozzle rows along the width direction, where a plurality of the liquid discharging nozzles are arranged along the medium transport direction in each nozzle row, wherein in the first state and the second state, the control unit uses the liquid discharging nozzles closer to an outside in the width direction going toward the downstream side in the medium transport direction of the liquid discharging nozzles to be used during predetermined dot formation, wherein in the third state, the control unit uses the liquid discharging nozzles which have a same position in the width direction of the liquid discharging nozzles to be used during the predetermined dot formation, and wherein in the fourth state, the control unit uses the liquid discharging nozzles closer to an inside in the width direction going toward the downstream side in the medium transport direction of the liquid discharging nozzles to be used during predetermined dot formation.

10. The recording apparatus according to claim 1, wherein the forming unit includes the upstream-side forming unit which is provided on the upstream side of the upstream-side transport unit in the medium transport direction and a downstream-side forming unit which is provided between the liquid discharge unit and the downstream-side transport unit in the medium transport direction, and wherein the control unit controls the discharging of the liquid of the liquid discharging nozzles according to a state corresponding to any one of a first state in which the medium is in contact with the upstream-side forming unit and the upstream-side transport unit and the leading end of the medium does not reach the downstream-side forming unit, a second state in which the medium is in contact with the upstream-side forming unit, the upstream-side transport unit, and the downstream-side forming unit, a third state in which the medium is in contact with the upstream-side forming unit, the upstream-side transport unit, the downstream-side forming unit, and the downstream-side transport unit, a fourth state in which the rear end of the medium leaves the upstream-side forming unit and the medium is in contact with the upstream-side transport unit, the downstream-side forming unit, and the downstream-side transport unit, and a fifth state in which the rear end of the medium leaves the upstream-side transport unit and the medium is in contact with the downstream-side forming unit and the downstream-side transport unit.

11. The recording apparatus according to claim 10, wherein the liquid discharge unit is provided with a plurality of nozzle rows along the width direction, where a plurality of the liquid discharging nozzles are arranged along the medium transport direction in each nozzle row, wherein in the first state, the control unit uses the liquid discharging nozzles closer to an outside in the width direction going toward the downstream side in the medium transport direction of the liquid discharging nozzles to be used during predetermined dot formation, wherein in the second state and the third state, the control unit uses the liquid discharging nozzles which have a same position in the width direction of the liquid discharging nozzles to be used during the predetermined dot formation, and wherein in the fourth state and the fifth state, the control unit uses the liquid discharging nozzles closer to an inside in the width direction going toward the downstream side in the medium transport direction of the liquid discharging nozzles to be used during predetermined dot formation.

12. The recording apparatus according to claim 1, wherein the downstream-side transport unit is output roller pairs which nip and transport the medium and is formed by nipping portions which nip one of the first convex portions and the second convex portions and escape portions which allow the other to escape being disposed alternately along the width direction when nipping the medium.

13. The recording apparatus according to claim 12, wherein the nipping portions in the transport roller pairs and the nipping portions in the output roller pairs are disposed at corresponding positions in the width direction.

* * * * *